US008410452B2

(12) United States Patent
Koenig et al.

(10) Patent No.: US 8,410,452 B2
(45) Date of Patent: Apr. 2, 2013

(54) ION SOURCE MEANS FOR DESORPTION/IONISATION OF ANALYTE SUBSTANCES AND METHOD OF DESORBING/IONISING OF ANALYTE SUBSTANCES

(75) Inventors: Simone Koenig, Muenster (DE); Klaus Dreisewerd, Muenster (DE); Alexander Pirkl, Rosendahl (DE)

(73) Assignee: Universitaetsklinikum Muenster, Muenster (DE)

( * ) Notice: Subject to any disclaimer, the term of this patent is extended or adjusted under 35 U.S.C. 154(b) by 117 days.

(21) Appl. No.: 12/994,935

(22) PCT Filed: May 29, 2009

(86) PCT No.: PCT/EP2009/003872

§ 371 (c)(1),
(2), (4) Date: Jan. 10, 2011

(87) PCT Pub. No.: WO2009/152945

PCT Pub. Date: Dec. 23, 2009

(65) Prior Publication Data

US 2011/0121173 A1 May 26, 2011

(30) Foreign Application Priority Data

May 29, 2008 (EP) ..... 08157207
Nov. 6, 2008 (EP) ..... 08019430

(51) Int. Cl.
*H01J 49/10* (2006.01)
*H01J 27/02* (2006.01)
*H01J 49/26* (2006.01)

(52) U.S. Cl. ..... 250/423 R; 250/424; 250/288; 250/281; 250/282; 250/287; 315/111.81

(58) Field of Classification Search ..... 250/288, 250/281, 282, 287, 423 R, 424; 315/111.81
See application file for complete search history.

(56) References Cited

U.S. PATENT DOCUMENTS

| | | | | |
|---|---|---|---|---|
| 6,787,764 | B2 * | 9/2004 | Park | 250/288 |
| 7,109,478 | B2 * | 9/2006 | Park | 250/288 |
| 7,335,897 | B2 * | 2/2008 | Takats et al. | 250/425 |
| 7,977,629 | B2 * | 7/2011 | McEwen et al. | 250/288 |
| 2006/0159916 | A1 | 7/2006 | Dubrow et al. | 728/357 |

FOREIGN PATENT DOCUMENTS

| | | |
|---|---|---|
| WO | WO 01/23863 | 5/2001 |
| WO | WO 03/081205 | 10/2003 |

OTHER PUBLICATIONS

"A PECVD CNT-Based Open Architecture Field Ionizer for Portable Mass Spectrometry", by L.F. Velasquez-Garcia et al., *MEMS*, 2008, pp. 742-745.
"8 Field Ionizatoin and Field Desorption", XP-002575959, 2009, pp. 355-380.
Search Report and Written Opinion from corresponding application No. PCT/EP2009/003872, dated Apr. 13, 2010.

* cited by examiner

*Primary Examiner* — Nikita Wells
(74) *Attorney, Agent, or Firm* — Westman, Champlin & Kelly, P.A.

(57) ABSTRACT

The invention relates to an ion source means comprising at least one holding means for holding at least one sample to expose the sample to a mass spectrometer device, wherein the holding means comprises a structured sample support means for supporting the sample and/or a structured sample or sample comprising a structured surface, respectively.

21 Claims, 23 Drawing Sheets

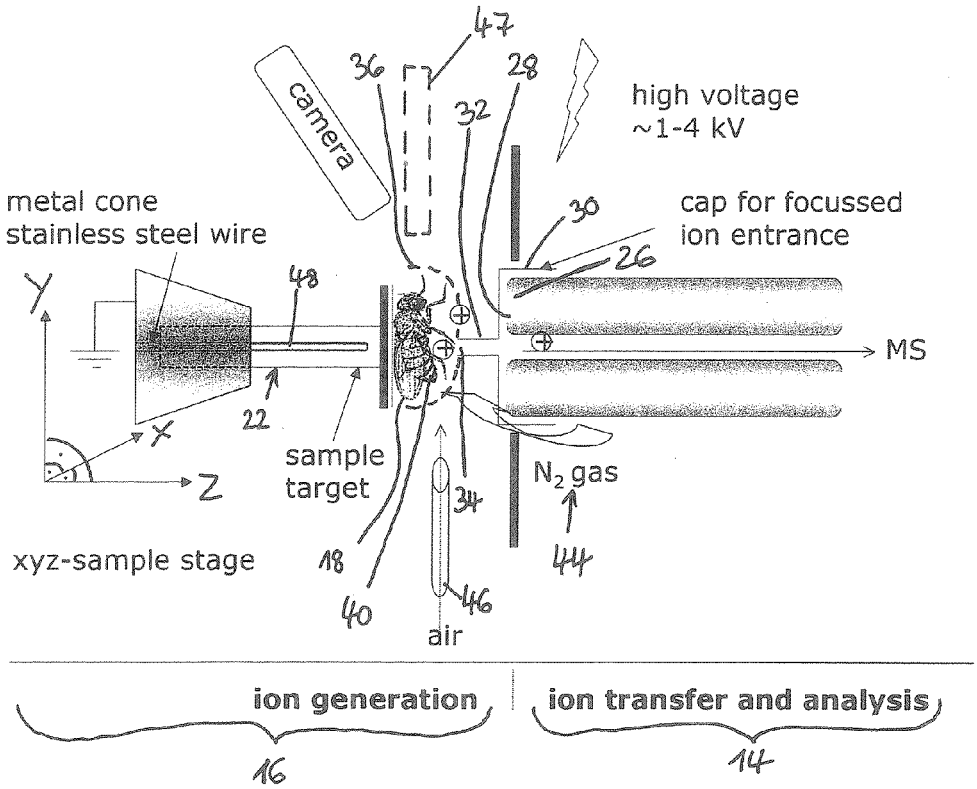
Fig. 5
Fig. 6a
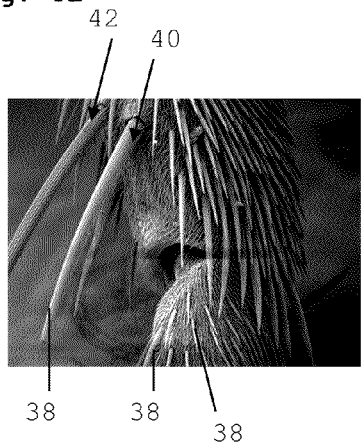
Fig. 6b
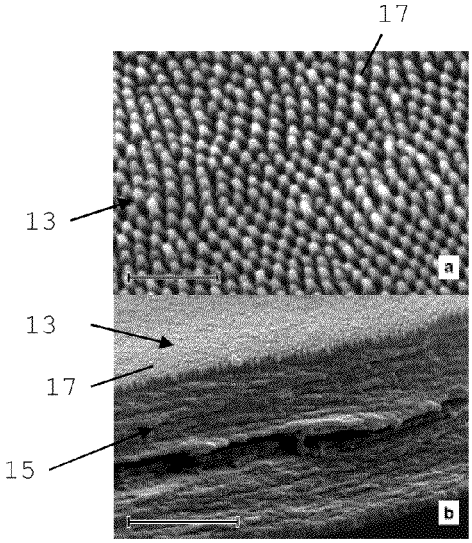
Micrographs of (a) the surface (scale bar = 1 $\mu$m) and (b) the cross section of a transparent region of the wing of *Cryptotympana aquila* (scale bar = 5 $\mu$m). The symmetric sandwich-like construction of this wing is apparent in the cross section view.

Fly 1

Fly 2

ION SOURCE MEANS FOR DESORPTION/IONISATION OF ANALYTE SUBSTANCES AND METHOD OF DESORBING/IONISING OF ANALYTE SUBSTANCES

CROSS-REFERENCE TO RELATED APPLICATION

This application is a Section 371 National Stage Application of International Application No. PCT/EP2009/003872, filed May 29, 2009 and published as WO 2009/152945 on Dec. 23, 2009, in English, the contents of which are hereby incorporated by reference in their entirety.

FIELD OF THE INVENTION

The present invention relates to an ion source means for desorbing and/or ionising analyte substances and a method of desorbing and/or ionising analyte substances. In particular the invention relates to an ion source means for the investigation of, e.g., living organisms by mass spectrometry using a suitable mass spectrometry device and to sample holding means or emitter means, respectively, suitable for desorbing and/or ionising analyte substances.

The invention concerns an instrumental development for the essential analytical technique called mass spectrometry (MS). In particular, the invention is directed to the technology of ion generation. The ion generation is performed for example at atmospheric pressure AP. Several desorption and ionisation methods and desorption/ionisation methods that operate atmospheric pressure have been developed for different purposes.

BACKGROUND OF THE INVENTION

In the state of the art electrospray ionisation ESI is known. Electrospray ionisation ESI and MALDI (matrix-assisted laser desorption/ionisation) with ultraviolet (UV) and infrared (IR) lasers can be used in combination with any mass spectrometer means, for example on an ion trap mass spectrometer. Recent developments in other laboratories include DESI (desorption ESI), DART (direct analysis in real time) and EESI (extractive ESI). In the first two methods either an electrospray or a stream of gas containing excited gas molecules (of e.g. He) and ionised water clusters, are used to desorb and ionise material from a sample at atmospheric pressure. The third method employs post-ionisation of desorbed molecules in a secondary ESI process.

Throughout the description molecules will be understood as neutral, i.e. uncharged species while ions are molecules carrying at least one charge. Ions can be desorbed from the sample when they already exist as ions in the sample or can be desorbed/ionised (i.e. desorbed and ionised) from the sample. In the latter case of the direct generation of ions from uncharged molecules the processes of desorption and ionisation are intertwined and shall be summarized as desorption/ionisation throughout the description. Alternatively, a post-ionisation means can however be used to ionise non-charged molecules that are desorbed simultaneously or exclusively.

In another related technique termed PESI (probe ESI) a solid needle is covered with a drop of sample solution which is then electrosprayed. In other related techniques gas phase molecules are first generated by desorption by any suitable technique, for example by electrospray or by laser desorption, and subsequently post-ionised. State of the art post-ionisation means are, for example, ionisation through interaction with ionising chemical agents, CI (chemical ionisation) and APCI (atmospheric pressure chemical ionisation), PI (photon ionisation; by interaction with a beam of photons) and APPI (atmospheric pressure photoionisation), and EI (electron ionisation) by interaction with a beam of electrons or EESI.

The comparatively old techniques of field desorption FD/field ionisation FI are also related to the invention, although such ion sources are operated in a high vacuum rather than at atmospheric pressure as in the invention.

SUMMARY OF THE INVENTION

The object of the invention is to provide a new ion source means and a method of carrying out desorption and/or ionisation of molecules and ions and/or desorption/ionisation of ions from a sample by using the ion source means.

This object is solved by the ion source means with the features of claim 1 and the method as claimed in claim 15.

According to the invention an ion source means is provided comprising:

at least one holding means for holding at least one sample to expose the sample, e.g., to a mass analyzer device, wherein the holding means comprises a structured sample support means for supporting the sample and/or a structured sample or sample comprising an at least partially structured surface, respectively.

Further, according to the invention a method for desorbing and/or ionising of at least one or more analyte substances is provided, including the steps of:

- providing a mass analyzer device,
- providing an ion source means, wherein the ion source means comprises at least one holding means for holding at least one sample to expose the sample to a mass analyzer device, wherein the holding means comprises a structured sample support means for supporting the sample and/or a structured sample,
- providing an atmosphere at substantially atmospheric pressure AP,
- providing a voltage difference between the sample holding means and a counter electrode which is sufficient to desorb ions and/or molecules from the sample, and
- measuring and evaluating the ions and ionised molecules generated in the ion source means and transferred to the mass analyzer device.

This has the advantage that a sample, e.g., an analyte solution can be applied to the structured sample support means. As a sample further volatile or gaseous samples or a combination thereof can be used. As a gaseous sample for example breath of an animal or human being, fumes, exhaust, aerosols etc. can be used in combination with the structured sample support means and investigated. Such a structured sample support means can comprise, e.g., a field emitter, a structure of microdendrites, tapered papillary structures, sharp tips or pins of, e.g., needles, wires or syringes tips, a sharp surface (e.g., sharp surface of a razor blade), a microstructured chip etc. When applying a voltage difference between the holding means and its counter electrode, respectively, a desorption of molecules and ions and/or desorption/ionisation of ions from the sample can be generated even under atmospheric pressure.

The same applies, when a structured sample or sample comprising an at least partially structured surface, respectively, is used. Such a structured sample or sample with an at least partially structured surface can be for example an insect like a fruit fly wherein, e.g., the cuticle of the fly comprises papillary structures or the legs of the fruit fly comprise hairs or a skin part of an animal or human being comprising hairs etc. The structure of, e.g., microdendrites, papillaries, hairs, whiskers, sharp tips of needles, wires, syringe tips or sharp surfaces (surface or sharp edge of a razor blade), microstructured chips etc. has the advantage that a local high field strength can be generated. This local high field strength supports desorption of molecules and ions (molecules will be understood as neutral, i.e. uncharged species while ions are molecules carrying at least one charge) and/or desorption/ionisation of ions (this case is direct to the generation of ions from uncharged molecules the processes of desorption and ionisation are intertwined and is summarized as desorption/ionisation throughout the description, as stated above). In principle each biological or artificial material can be used as sample to be investigated according to the invention which has such kind of structure which creates a locally high field strength or a similar structure which is suitable to create a local high field strength.

Further embodiments and developments of the invention can be derived from the dependent claims and the description with reference to the figures.

In an embodiment of the invention the structured sample support means is provided for example with a nano structure or fine structure, for example a structure of microdendrites or whiskers or papillaries or a structure of a tip or tips or pins (e.g., sharp or blunt tips or pins of a syringe, wire or needle), sharp surface (e.g. sharp surface or edge of a razor blade) or the like. As mentioned before, such a structure can generate a local high field strength which supports desorption of molecules and ions and/or desorption/ionisation of ions.

In a further embodiment according to the invention at least one or a plurality of analyte substances are provided on the structured sample support means as a sample to be analyzed. In this connection, the analyte substance can be for example analyzed in the presence of a liquid material or moisture in the ambient air, e.g., water or any other suitable solution. Further, the analyte substance can be for example a liquid, paste-like, solid, volatile and/or gaseous analyte. In this connection, the presence of a liquid material or moisture in the ambient air can be used in connection with the liquid, paste-like, solid, volatile and/or gaseous analyte or can be omitted. As a gaseous analyte for example breath of an animal or human being, fumes, exhaust, aerosols etc. can be investigated. However, the invention is not limited to these examples. In fact any gaseous solution or volatile solution or combination thereof can be investigated.

In another embodiment of the invention the structured sample is for example a biological or artificial material, in particular for example a living or dead animal, e.g., an insect, like a fly, beetle, caterpillar etc., or a body part of such an animal or a part of an animal or part of a human being, e.g., a skin/cuticular part, or a plant or a part of a plant, e.g., a part of a leave etc. In particular the possibility of analyzing a living animal like a fruit fly has the advantage, that the animal can be analyzed in different phases or stages of its development or life cycle.

According to a further embodiment of the invention the ion source means can comprise additionally at least one air supply means to provide an additional flow of air or oxygen. Further, the ion source means can comprise at least one additional counter gas means for providing a flow of counter gas. Preferably, the temperature of the counter gas of the counter gas means is variable. During analysis of a sample the temperature of the counter-gas flow can be adjusted, so that the counter-gas has a suitable temperature to assist desorption of molecules and ions and/or desorption/ionisation of ions from the sample. The temperature of the counter gas means can vary between, e.g., 20° C. to 400° C. However, the temperature can be also lower than 20° C. or higher than 400° C. depending on the function and intended use. Moreover, the ion source means can be provided with at least one additional laser means, e.g., an IR laser and/or UV laser to assist desorption of ions of the sample. Furthermore, other desorption and/or ionisation means such as, e.g., an electrospray or nanospray means can be used in connection with the ion source means to assist for example desorption of molecules and/or ions and/or desorption/ionisation of ions from the sample.

In another embodiment of the invention an additional post-ionisation means can be applied to generate ions from desorbed molecules. This can for example be achieved by interaction with a beam of electrons, photons or ionising chemical compounds.

In another embodiment of the invention an electrical field can be generated between the holding means and the counter electrode. The counter electrode can be part of the ion source means comprising the invention or for example comprise a part of the mass analyzer, e.g. a transfer capillary of a mass analyzer means, e.g. of an ion trap mass analyzer. Preferably, the strength of the electrical field is chosen so that it is, e.g., sufficient to desorb or to assist desorption of molecules and ions and/or desorption/ionisation of ions from the sample of the ion source means.

In a further embodiment of the invention a voltage to generate the electrical field can be applied to the holding means, while the counter electrode is at ground potential. In an alternative, the voltage can be applied to the counter electrode while the holding means is at ground potential. The voltage difference to be applied can be in a range of, e.g., 1 kV to 4 kV or larger or also lower. Furthermore positive or negative voltages can be applied. In this connection a Delayed Ion Extraction (DE) can be applied. This means, that the voltage difference between the holding means comprising the sample and the counter electrode can be applied only after a certain time after application of, e.g. a laser pulse or a gas pulse or after application of post-ionisation. This can have the advantage that the sensitivity may be enhanced. In this connection a Pulsed Dynamic Focussing (PDF) can also be applied. This means, that the voltage difference between the holding means comprising the sample and the counter electrode, e.g. the inlet capillary of an ion trap mass spectrometer, can be applied only for a certain time before the voltage is turned off and a zero-field is generated. This can have the advantage that the sensitivity may be enhanced.

In an embodiment of the invention, the desorption of molecules and/or ions and/or the desorption/ionisation of ions from the sample is carried out for example under substantially atmospheric pressure AP. This has the advantage, that it is possible to investigate for example living animals.

In a further embodiment the holding means is fixed or it is adapted to be movable in one, two and/or three dimensions. A movable holding means has the advantage that the position of the sample relative to the mass analyzer device can be adjusted so that for example a sufficient or better ion signal can be received. This can also have the advantage that a higher spatial resolution is achieved.

According to another embodiment of the invention, the holding means can be provided with a tape or sticker on which the structured sample or the structured sample support means can be attached. In an alternative solution the holding means can comprise a fix plate element, e.g., out of metal, wherein a tape or sticker can be provided on the plate element to attach the structured sample or structured sample support means to the tape or sticker. The tape has the advantage that it can be removed from the holding means after investigation of the sample and can be used at a later stage for example again.

In another embodiment of the invention the tape or sticker on which the structured sample or the structured sample support means can be attached can be electrically conductive. This has the advantage that the tape or the sticker provides an electrical contact between the holding means and the sample.

In another embodiment of the invention the holding means comprises a carrier element which is either fix or removably attached to the holding means, e.g., by a magnet element an/or by a snap-in-place connection, wherein a tape or sticker, which can be electrically conductive, can be provided on the carrier element to attach the structured sample or structured sample support means to the tape or sticker.

In a further embodiment of the invention the holding means can be provided with a field emitter means, e.g. a field emitter array or field emitter. Such emitters can be provided with a microdendrite structure, a microstructure or microstructures, at least one or a plurality of tips or pins (e.g., a sharp or blunt tip of a syringe and/or pins of a needle or wire), at least one or a plurality of sharp surfaces (e.g., sharp surface or edge of a razor blade) which can provide a local high field strength or any other suitable structure to create such a local high field strength to assist desorption of molecules and ions and/or desorption/ionisation of ions from a sample.

According to an embodiment of the invention, the holding means comprises a conductive contact, e.g. a metal contact, e.g. a metal plate, a metal wire, a metal cone, a metal cylinder or a metal shaft or any other suitable metal element etc., to provide an electrical potential at the sample. To generate a voltage difference between the holding means and the counter electrode a voltage can be applied to the holding means or the holding means can be provided at ground potential while the counter electrode is provided with a suitable voltage. As mentioned above a Delayed Ion Extraction (DE) or a Pulsed Dynamic Focussing (PDF) or any other technique which enhances sensitivity can be applied. That means, the voltage difference can be applied between the holding means and the counter electrode for a certain time.

According to the invention the inventive ion source means can be used for analysis of a sample with a mass spectrometer device. Suitable mass spectrometer devices are for example a Q-TOF mass spectrometer device, an orthogonal-extracting TOF-mass spectrometer device, an ion trap mass spectrometer device, a multistage-quadrupole mass spectrometer device, or a Fourier-transform ion cyclotron resonance mass spectrometer device. However, the invention is not restricted to these examples of mass spectrometer devices. It is obvious for the person skilled in the art that other mass spectrometer devices can be used as well.

In an embodiment of a mass spectrometer device, said device comprises one collecting means, for example a capillary, to collect ions from the sample. Optionally a cap means can be provided at the entrance of the collecting means, e.g., the capillary entrance, wherein the cap means comprises at least one opening or at least one tube element, wherein the tube element can form, e.g., a cylindrical tube or a funnel. The tube element has the advantage that for example, defined positions on the sample, e.g. of an animal, e.g. an insect like a fly, e.g. the leg or part of the corpse of an insect like a fly can be better reached, since the tube element is smaller compared for example with the standard capillary of the mass spectrometer device. This may increase the spatial resolution of the analysis.

In a further embodiment of the invention a method is provided for carrying out desorption of molecules and ions or desorption/ionisation of ions from a sample. The method uses an inventive ion source means as described in the present description and a suitable mass spectrometer device. To desorb ions from a sample like a fly an electrical field is generated. Further, the analysis is carried out substantially under atmospheric pressure AP. Preferably, the sample can be moved in a position relative to the counter electrode, so that a sufficient ion signal is achieved. The counter electrode can for example be comprised by the entrance of the transfer capillary of a mass spectrometer device, e.g. an ion trap mass spectrometer. In an alternative solution an electrical field can be generated independent from a mass spectrometer device, by creating an electrical field between the holding means of the sample an a counter electrode. After the ion beam has passed the counter electrode the ion beam can be directed, e.g., to a mass analyzer device. In other words, the counter electrode can be a part of a mass analyzer device or not. Both is possible.

Optionally at least one additional counter-gas means, laser means, electrospray means, and/or other desorption/ionisation means can be further used to assist desorption of molecules and ions or desorption/ionisation of ions from the sample as described before. Furthermore, at least one additional post-ionisation means like a beam of electrons, photons or ionising chemicals can be used to ionise desorbed molecules. Furthermore, at least one additional air supply means can be used to keep, e.g., an animal alive during analysis.

In another embodiment of the invention a holding means for holding at least one sample to expose the sample to a mass analyzer device is provided. The holding means comprises a structured sample support means for supporting the sample, e.g., an emitter means provided with a structure of microdendrites, whiskers, pins, tips, edges, microstructures, nanostrucutres or wires. Further, the holding means can comprise in addition or as an alternative a structured sample or sample comprising a structured surface, respectively. The structure of the sample or the sample support means has the advantage that it can generate a locally high field strength. Furthermore, the holding means can comprise a conductive, e.g. a metal element or metal layer(s) to apply a voltage to the holding means to generate desorption of molecules and/or ions from the sample or to assist desorption of molecules and ions and/or desorption/ionisation of ions.

According to another embodiment of the invention a cap means is provided which can be used, e.g., with a transfer capillary of a commercial mass spectrometer device. The cap means can be provided at the capillary entrance of said mass spectrometer device, wherein the cap means can comprise at least one opening or at least one tube element, wherein the tube element can form, e.g., a cylindrical tube or a funnel to assist collecting of ions from a sample.

In a further embodiment of the invention a laser means can be provided to be used with an ion source means. The laser means is, for example, an IR laser or UV laser and can assist desorption of molecules and ions and/or desorption/ionisation of ions from a sample.

In another embodiment of the invention an additional post-ionisation means like a beam of electrons, photons or ionising chemicals can used with the ion source means. The additional post-ionisation means can be used to ionise desorbed neutral molecules.

In another embodiment of the invention an additional air supply means can be used with an ion source means. The additional air supply means can be used to support keeping an animal like a fly alive during analysis by a mass spectrometer device.

In a further embodiment of the invention a structured sample support means can be used with an ion source means, wherein the structured sample support means comprises a structure which provides a locally field strength. In this connection, the structured sample support means can be provided with, e.g., microdendrites, whiskers, tips, pins, microstructures, nanostructures, edges, sharp surfaces and/or wires etc.

According to another embodiment of the invention, a sample preparation means for use with an ion source means can be provided. The sample preparation means comprises a micromanipulator to position a sample, e.g., a structured sample, or an analyte on a structured sample support means. In this connection, the micromanipulator can be provided additionally with a magnifying apparatus to assist application of the analyte on the structure of microdendrites or whiskers etc. without damaging this structure.

In a further embodiment of the invention a positioning means for use with an ion source means can be provided, wherein the positioning means is adapted to position the holding means of the ion source means in one, two or three dimensions. The positioning means can be for example a positioning means for the z-direction to achieve that a probe target/sample holder of a commercial ion source means can be positioned for example not only in the X- and y-direction but also in the z-direction.

The foregoing and other objects, features and advantages of the invention will be apparent from the following more particular description of preferred embodiments of the invention, as illustrated in the accompanying drawings in which like reference signs refer to the same or similar parts throughout the different views. The drawings are not necessarily to scale, emphasis instead being placed upon illustrating the principles of the invention.

A more detailed understanding of the invention may be had from the following description of preferred embodiments, given by way of example and to be understood in conjunction with the accompanying drawing, wherein:

BRIEF DESCRIPTION OF THE DRAWINGS

FIG. 5 is an embodiment of an ion source means according to the invention which is connected with a mass analyzer device to form a mass spectrometer device;

FIG. 6*a* is a secondary electron image of a fly leg;

FIG. 6*b* is a secondary electron image of the surface and a cross section of a transparent region of the wing of *Cryptotympana aquila;*

DETAILED DESCRIPTION OF THE DRAWINGS

In the figures the same reference numbers denote the same or functionally similar components, unless otherwise indicated.

Scientists interested in the chemical changes associated with animal behaviour wish to measure the appearance and quantity of certain chemicals on their cuticle or in surface secretions like e.g. pheromones with respect to environmental influences or challenges such as fight, mating, sleep, deprivation of food and so on. Similarly, to profile such compounds is of interest in various other fields, e.g. entomology.

However, one problem is that, in most cases, samples that are amenable to mass spectrometric analysis can only be generated by extraction of molecules from tissue or the surface by the application of solvents. In the case of the analysis of living small animals like insects this step is typically accompanied by sacrificing the animal. The investigation of volatile molecules obtained from living insects using an air stream has been shown using gas chromatography GC/mass spectrometry MS coupled devices but is restricted to small molecules of sufficient volatility.

Figure 1:
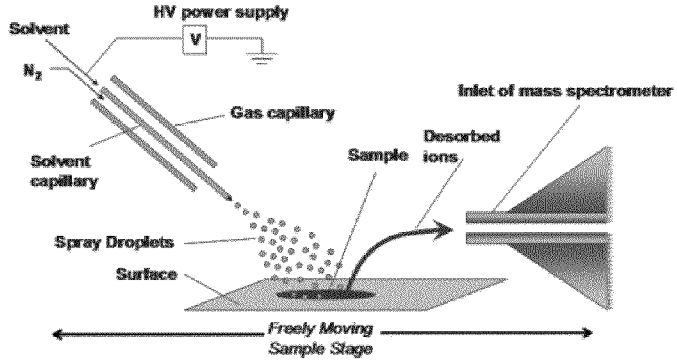
FIG. 1 is a schematic drawing of the DESI principle.

FIG. 1 shows a schematic drawing of the DESI (desorption ESI) principle. As can be derived from FIG. 1 electrosprayed droplets are directed pneumatically assisted onto a surface of a sample to be analyzed at atmospheric conditions. Desorbed ions of the sample are extracted into the mass spectrometer. Figure adopted from www.prosolia.com/DESI.html.

Figure 2:
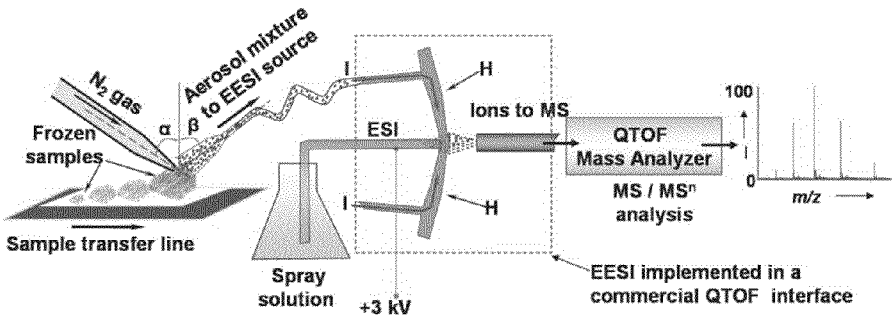
FIG. 2 is a schematic drawing of the EESI principle.

Further, in FIG. 2 a schematic drawing of the EESI (extractive ESI) principle is shown. As shown in FIG. 2 the desorption and ionisation of molecules of a sample to be investigated is spatially separated. This provides more gentle conditions for the sample allowing the investigation of living objects. According to the EESI principle the compounds from biological samples are desorbed by a nitrogen flow, which creates a neutral aerosol mixture containing molecular metabolites. The aerosol is transported to the ESI source where analyte molecules are entrained in an ESI spray and ionised. Figure adopted from Chen, H., Wortmann, A., Zenobi, R. Neutral desorption sampling coupled to extractive ESI-MS for rapid differentiation of biosamples by metabolic fingerprinting. J. Mass Spectrom. 42 (2007) 1123-1135.

Further variants of the ESI post-ionisation method are the desorption of neutral biomolecules by either an IR laser or UV laser instead of the gas beam.

Figure 3:
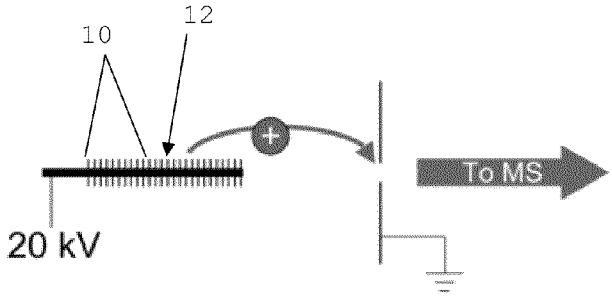
FIG. 3 is a schematic drawing of the techniques of field desorption FD/field ionisation FI.

FIG. 3 shows a schematic drawing of the techniques of field desorption FD/field ionisation FI. According to these techniques ions are generated in vacuum from sharp points such as microdendrites 10 by means of a locally very strong electric field. FIG. 3 is adopted from http://en.wikipedia.org/wiki/Field_desorption.

Figure 4:
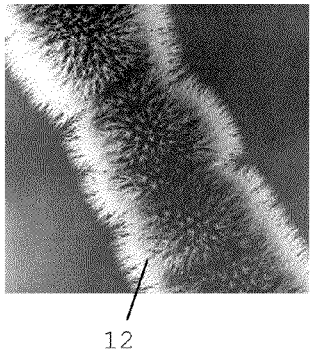
FIG. 4 is a field emitter with a filament from which tiny "whiskers" have formed.

As shown in FIG. 3 an electrical potential of 20 kV, is applied to an emitter 20 with a sharp surface, such as a razor blade, or more commonly, a filament from which tiny "whiskers" 12 have formed, as shown in FIGS. 3 and 4. FIG. 4 is adopted from Gross, J. H. Mass spectrometry, A textbook. Springer-Verlag Berlin, 2004.

This results in locally very high electrical field strengths which can result in desorption of molecules and ions and/or desorption/ionisation of the analyte applied to the sharp surface (typically from solution). Field desorption FD/field ionisation FI is one of the few ionisation techniques that can produce simple mass spectra with molecular information from hydrocarbons and other nonpolar compounds.

The basis of the invention is the discovery made by the inventors that ions of biomolecules are emitted from the surface of an emitter or emitter means (sample supporting means), respectively, such as a natural emitter means like, e.g., fruit flies or artificial emitter means like, e.g., tips or pins of a needle or syringe, wires, microstructures, nanostrucutres etc., under certain conditions when they are exposed to an electric field. This observation is partially explained with field desorption and emission effects from special surface structures of the emitter means, e.g., the surface of an insect or the sharp or blunt tip of a syringe or the sharp or blunt pin of a needle.

A further basis of the invention is the discovery made by the inventors that ions of gaseous compounds can be emitted from a structured surface or by the presence of a structure surface under certain conditions when the gaseous compounds are exposed to an electric field. As a gaseous sample for example any aerosol, human breath, animal breath, fume and/or exhaust etc. can be used to be investigated according to the invention. It has to be emphasized that the invention is not restricted to the examples of a gaseous sample mentioned before.

The invention concerns the aspects of desorption of molecules and ions from a sample as well as the ionisation of desorbed or volatile molecules from the sample at specific conditions (indicated in the following as field-based ion generation (FBIG) conditions) or FLIE conditions, when flies are used as emitter means. The specific conditions (FBIG-conditions) or FLIE conditions with respect to flies used as emitter means will be described in further detail below. Mechanistically, in the direct generation of ions these processes are intertwined and shall be summarized as desorption/ionisation throughout the description. In other words, the invention also concerns the aspect that ions can not only be desorbed from the sample when they already exist as ions in the sample but can be also desorbed/ionised (i.e. desorbed and ionised) from the sample. In the latter case of the direct generation of ions from uncharged molecules the processes of desorption and ionisation are intertwined and is summarized as desorption/ionisation throughout the description as stated above. Further, a gaseous analyte or gaseous sample can be investigated, wherein, e.g., a structured sample support means can assist desorption/ionization of gaseous compounds of the sample or samples, when an electrical field is applied. For instance, common contaminants from laboratory air have been identified as will be explained below with respect to, e.g., FIGS. 20 to 23.

Alternatively, a post-ionisation means can however be used to ionise non-charged molecules generated simultaneously or exclusively.

According to the invention cuticular substances and secretions of the insect can be profiled which is, for example, of importance in behavioural studies. It is shown that even living animals can be investigated, e.g., small animals as insects like flies (e.g., fruit flies), beetles etc.

The invention concerns the design of an ion source means (FLIE: Fly Ion Emission in case a fly is used as a sample to be investigated) which allows the investigation of, e.g., living and/or dead insects or other organisms as well as body parts and any other biological or artificial materials susceptible to the experiment described in the invention. Further parts of the invention are means of sample preparation and further sample holding means such as natural or artificial emitter means. In particular, the inventive ion source means allows the investigation of volatile analytes and gaseous analytes, such as for example the breath of an animal or human being, fumes, exhaust and/or aerosols etc. To describe the mechanism of ion generation the term filed-based ion generation (FBIG) was introduced.

The inventive ion source means can be fitted to many mass spectrometer devices, e.g., a Q-TOF mass spectrometer device, an orthogonal-extracting TOF mass spectrometer device, an ion trap mass spectrometer device, a multistage-quadrupole mass spectrometer device, a Fourier-transform ion cyclotron resonance mass spectrometer device etc. However, these are only some examples for mass spectrometer devices which can be used with the inventive ion source means. The invention is not restricted to these examples. It is obvious for the person skilled in the art that many other mass spectrometer devices can be used with the inventive ion source means. Alternatively, commercial ion sources such as, e.g., those for manual nanospray can be transformed into an inventive ion source means using adapters. This applies also to other commercial ion source means. The above mentioned example is only one among a plurality of commercial ion source means which can be transformed into an inventive ion source means. The invention is not restricted to this example.

The invention covers both an ion source means constructed according to the principles published in this invention and the adapter means necessary to transform commercial ion sources into an inventive ion source means.

The invention also covers the use of sample targets or emitters of natural origin like, e.g. animals like insects (flies etc.), plants etc., or artificial origin, like microdendrites, whiskers, papillaries, tips of syringes, pins of needles, sharp surfaces (e.g., surface or edge of a razor blade), wires etc., whose fine structure (e.g. microstructure and/or nanostructure etc.) creates a local high field strength and allows ion generation, e.g., at "FLIE conditions" or FBIG-conditions, respectively.

FBIG-conditions or FLIE conditions (in case a fly is used as a sample), respectively, means that an investigation of a sample can be carried out under, e.g., atmospheric pressure and by the generation of an electrical field which is sufficient for the desorption of molecules and/or ions and/or desorption/ionisation of ions from the sample. In particular the means allows to analyse volatile molecules and also non-volatile and relatively large molecules and further molecules in a gaseous analyte. To generate the electrical field a voltage difference can be applied between the holding device and the counter electrode, in a range, e.g., preferably between 1 kV to 4 kV. This voltage difference can also be higher or lower and may also be varied in a temporal fashion.

In summary, the challenges are both the direct investigation of living organisms, gaseous and/or volatile analytes, and the measurement of molecules, including in particular non-volatile molecules, from their surface like, e.g., hydrocarbons, triglycerides, phospholipids, carbohydrates, peptides, etc. However, hydrocarbons, triglycerides, phospholipids, carbohydrates and peptides are only a few examples for molecules which can be measured. It is obvious for the person skilled in the art that any other forms of molecules can be measured as well. The invention is not restricted to the mentioned examples of molecules. They are just exemplary.

In general, the invention concerns instrumentation and sample preparation technology in the area of mass spectrometry. Mass spectrometry is an analytical detection technique by which the molecular weights of natural and artificial compounds are determined. Mass spectrometry is of enormous importance in modern day research, for example in quality and process control.

Specifically, the invention is potentially of great importance for any investigations concerning insects (e.g. entomology, behavioural science etc.) as well as other organisms (e.g. zoology) or natural and artificial materials responsive of the method described (e.g. botanic, agriculture, surface science, etc.). In particular, the invention is of potentially great importance for any investigation of volatile analytes and/or gaseous analytes such as breath of, e.g., animals and human beings etc., exhaust, fumes and/or aerosols etc.

Figure 19:
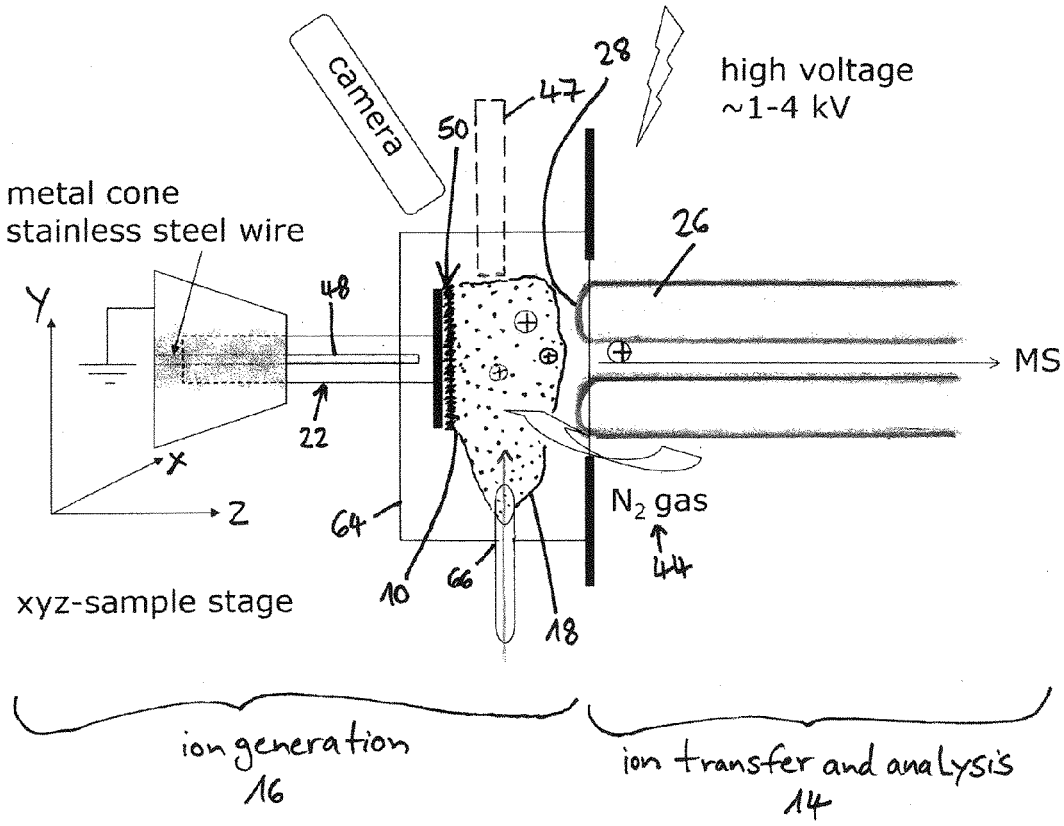
FIG. 19 is a further embodiment of an ion source means according to the invention which is connected with a mass analyzer device to form a mass spectrometer device, wherein a gaseous analyte is investigated.

The general principle of an inventive ion source means associated to a mass analyzer device to form an inventive mass spectrometer device is depicted in FIGS. 5 and 19. Therein, embodiments of the inventive ion source means 16 are disclosed, wherein the inventive ion source means 16 is coupled to one example of a mass analyzer device 14. However, the invention is note restricted to a mass analyzer device as shown in FIGS. 5 and 19. The embodiments shown in FIGS. 5 and 19 are only exemplary. The inventive ion source means can be also used in connection with a plurality of other mass analyzer devices of a mass spectrometer device. Further, the ion source means can be also used independent of a mass analyzer device. Moreover the ion source means can be also used in connection with a gas-phase chromatograph.

The ion source means 16 comprises at least one or a plurality of samples 18. In the present case, as shown in FIG. 5, one structured sample 18 is provided which is, e.g., an insect like a fly, e.g., a fruit fly. The structured sample 18, i.e., the insect is located on a holding means 22 of the ion source means 16. The holding means 22 can be fix or can be adapted to be movable or adjustable, respectively, in one, two or three dimensions, e.g., along the x-, y- and/or z-axis as shown, exemplary, in FIG. 5. This allows an optimisation of the ion signal and a spatially-resolved analysis by moving the sample 18 in an optimal position relative to a counter electrode. In the embodiment presented in FIG. 5, this counter electrode forms, e.g., the entrance capillary 26 of the mass analyzer device 14. As shown in FIG. 5 the capillary 26 is arranged, e.g., substantially opposite to the holding means 22 and its sample 18 to collect ions emitted from the sample 18 or ions that optically generated from molecules emitted from the sample 18 by a post-ionisation means.

In one embodiment as shown in FIG. 5, the entrance 28 of the capillary 26 can be provided with an additional cap means 30 including, e.g., at least one opening or at least one tube element 32 extending from the cap means 30 to collect ions emitted from the sample 18. The cap means 30 can provide opening(s) 34 with variable diameter and geometry. However, the cap means 30 can be provided on any other collecting means to collect ions from the sample 18. The invention is not restricted to a capillary 26 as a collecting means to collect ions. In principle, the cap means 30 can be provided on any other collecting means which collects ions from the sample 18.

The opening(s) of the cap means 30 including the opening 34 of the tube element(s) 32 can be small, e.g., smaller than the opening of the capillary 26 to collect ions and/or molecules, e.g., from a partial area or sub-area of the sample 18 and not substantially from the complete or a larger area of the sample 18. When moving the sample 18 along the cap means 30 ions and/or molecules from different areas of the sample 18 can be collected and allocated to these areas. Thus the investigation of the sample 18 can be further refined and a spatially-resolved analysis can be provided.

However, the opening 34 can be also provided with substantially the same size as the opening of the capillary tube 26 or a larger size as indicated by the dotted lines in FIG. 5 to form a kind of funnel 36 to encompass a large area or substantially the complete area of the sample 18. In the present case, the tube element 32 comprises a funnel portion 36 which encompass, e.g., substantially the complete area of the fly (sample) to collect ions and/or molecules emitted from the fly.

To emit molecules and/or ions from the sample 18 an electrical field is generated by the application of a voltage difference between the holding means 22 holding the sample 18 and the counter electrode. The counter electrode can for instance be formed by the transfer capillary 26 of a mass analyzer device 14. However, any other counter electrode can be used instead depending on the function and purpose. The invention is not restricted to the transfer capillary 26 as counter electrode, this is only one example among a plurality of possibilities.

A high voltage difference in a range, e.g., between positive or negative 1 kV to 4 kV can be applied to the counter electrode 26 while the holding means 22, i.e., the sample stage, is at ground potential. On the other hand, the voltage in a range between, e.g., positive or negative 1 kV to 4 kV can be also applied to the holding means 22, while the counter electrode, which can for instance be formed by the transfer capillary 26 of the mass analyser device 14 is at ground potential.

However, the range of 1 kV to 4 kV is only exemplary and the invention is not restricted to this exemplary range. The voltage difference can be also less than 1 kV or larger than 4 kV and can be constant or variable and can also be varied in a temporal fashion. The height of the voltage is selected, e.g., so that a suitable voltage difference between the holding means 22 and the counter electrode can be achieved, so that ions and/or molecules can be emitted from the sample 18.

In this connection, further a locally high field strength can be generated, e.g., by the presence of surface structures such as for example hairs 38 or whiskers 12, or papillaries 17 on an insect body 40 as shown in FIGS. 5 and 6. In FIG. 6 a secondary electron image of a fly leg 42 is disclosed (see Gsc.nrcan.gc.ca, by picture Google search).

Such a local field strength can be also generated by adding structures that enhance the local field in the analysis of other samples. This can be achieved, e.g., by the provision of a structure of microdendrits 10 or whiskers 12 as shown, e.g., in FIGS. 3 and 4 and as described, e.g., in DE 2615523 (Linden et al), or tips of syringes, pins of needles, edges or sharp surfaces of a razor blade or the like, wires, microstructured chips etc. A holding means 22 provided with such a structure, e.g., of microdendrits 10, or whiskers 12, or papillaries 17, or pins, or tips, or edges (sharp edge of a razor blade), or microstructures (e.g., microstructures provided on a chip) or nanostructures or wires etc. can be provided with an analyte substance or analyte substances to be investigated.

As can be derived from FIG. 5 optionally an additional counter gas means 44 (indicated by an arrow in FIG. 5) can be provided which supplies a counter gas flow, e.g., from the entrance of the mass analyzer device 14 opposite of the sample 18. Such a counter gas flow is used, e.g., to prevent solid or neutral material from entering the mass analyzer device 14 and to potentially assist the desorption of analyte molecules and ions and desorption/ionisation of ions or even forms a prerequisite. In the representation of FIG. 5 case nitrogen counter gas is used. However, instead of nitrogen gas any other suitable gas can be used. The counter gas can be further adjusted to assist, e.g., the ion generation.

In the examples of the invention, which will be described below with reference to FIGS. 10 to 17 a counter gas means 44 is used, wherein the counter gas flow is heated or adjusted to a temperature of, e.g., up to 300° C. However, the invention is not restricted to this range. The temperature of the counter gas flow can be varied arbitrarily, and can be even higher than 300° C. depending on its function and intended use.

As shown in FIG. 5, optionally an additional air supply means 46 can be provided to supply air or oxygen towards the sample 18. Such an air supply means 46 can be provided, e.g., if a living animal is used as a sample 18 to be analyzed, e.g., an insect like a fly as shown in FIG. 5. The air stream can be used to support keeping the animal alive during investigation. However, the inventors have found out that such an additional air supply means 46 is not absolutely essential since animals like for example flies etc. are able to stay alive while the investigation is carried out, even when there is no additional air supply means 46. This is described further below with reference to the Examples shown, e.g., in FIGS. 10 to 17.

As is indicated in FIG. 5 by the dashed line, optionally at least one or more additional post-ionisation means 47 as described above can be provided to ionise molecules, e.g. neutral molecules, desorbed from the sample. In a variant such a post-ionisation means 47 can also be provided after collection of molecules e.g. by a directed gas flow through a collecting capillary. As a post-ionisation means 47 a beam of electrons, photons or ionising chemicals can be used with the ion source means 16.

The design of the ion source means 16 comprising the holding means 22 and the sample 18 accommodates the invention (also basis of this application) that ions and/or molecules are emitted, e.g., from fruit flies when these are exposed to an electric field. The mechanism of desorption/ionisation is currently under investigation.

When generating ions from a sample 18 like a fruit fly, the inventors have further discovered that an additional electrospray means or nanospray means or any other means assisting desorption and ionisation (not shown), respectively, to generate ions and/or molecules is not necessary. Optionally an electrospray means or nanospray or other means can be used to assist ionisation, but it is not essential as in the state of the art described above with respect to FIGS. 1 and 2. Optionally, a stream of gas containing excited gas molecules, e.g., He, and ionised water clusters can be used to assist desorption and ionisation of material from a sample 18. Optionally, a post-ionisation means 47, for example based on a APCI, APPI, EI, or EESI method, can be applied to ionise molecules emitted from the surface.

Further, additional laser means (not shown) to assist desorption of molecules and ions and/or desorption/ionisation of ions like, e.g., ultraviolet (UV) and infrared (IR) lasers etc. to create ions and/or molecules are also not necessary. Optionally, they can be used to assist ionisation. Furthermore, a sample 18 can be investigated under atmospheric pressure AP according to the invention.

Instead of a fruit fly as described before, also, e.g., a liquid, solid, paste-like, gaseous and/or volatile sample can be investigated employing microstructured sample holders. In these cases, a structured sample support means can be provided which is brought in contact with the sample. When a volatile and/or gaseous sample is investigated a flow of the volatile and/or gaseous sample can be brought into contact with the structured sample support means for desorption/ionisations of ions from the sample. The structured sample support means can comprise at least one or a plurality of microstructured chips, wires, sharp and/or blunt tips (e.g., a tip of a syringe), sharp and or blunt pins (e.g., a pin of a needle or wire), sharp surfaces or sharp edges (e.g., a sharp surface or edge of a razor blade), whiskers etc.

Several aspects are assumed to be of importance for ion generation, in particular:

1. A strong electric field. This can be achieved by providing a suitable voltage difference between the holding means 22 carrying the sample 18 and the counter electrode, in the present case of FIG. 5, e.g., the entrance capillary 26 of the mass analyzer device 14.

Further, a locally high field strength can, for example, be generated by the presence of surface structures such as hairs 38 or papillaries on an insect body as shown, e.g., in FIGS. 5, 6*a*, 6*b*, 24, 25, 26 and 27, or by adding structures that enhance the local field in the analysis of other samples. This can be achieved, e.g., by the provision of a structure of microdendrits 10 or whiskers 12 as shown, e.g., in FIGS. 3 and 4 and as described, e.g., in DE 2615523 (Linden et al) or by the provision of tips, such as tips of syringes, by the provision of pins, such as pins of needles, by the provision of razor blades, by the provision of wires, or by the provision of microstructured chips etc. In FIG. 6*b* a secondary electron image of a surface 13 and a cross section 15 of a trans-parent region of the wing of *Cryptotympana aquila* is shown. The wing comprises papillaries 17. Being placed within two electrodes, e.g., between a sample plate and extraction capillary, these structures alter the electrical field generated between the two electrodes when a voltage difference is applied and are able to generate a local high field strength.

2. The presence of ionisable, e.g. liquid, volatile and/or gaseous analyte, material on biological material such as, e.g., secretions on the skin/cuticule. In addition, for example ambient moisture may assist the process.
3. The emission of compounds, e.g., ionised molecules, from the sample 18.
4. The optional counter gas means 44 providing a counter-gas flow with an adjustable temperature.
5. The position of the sample 18 relative to the counter electrode, which is e.g. the entrance capillary 26 of a mass analyzer device 14.

Figure 8:
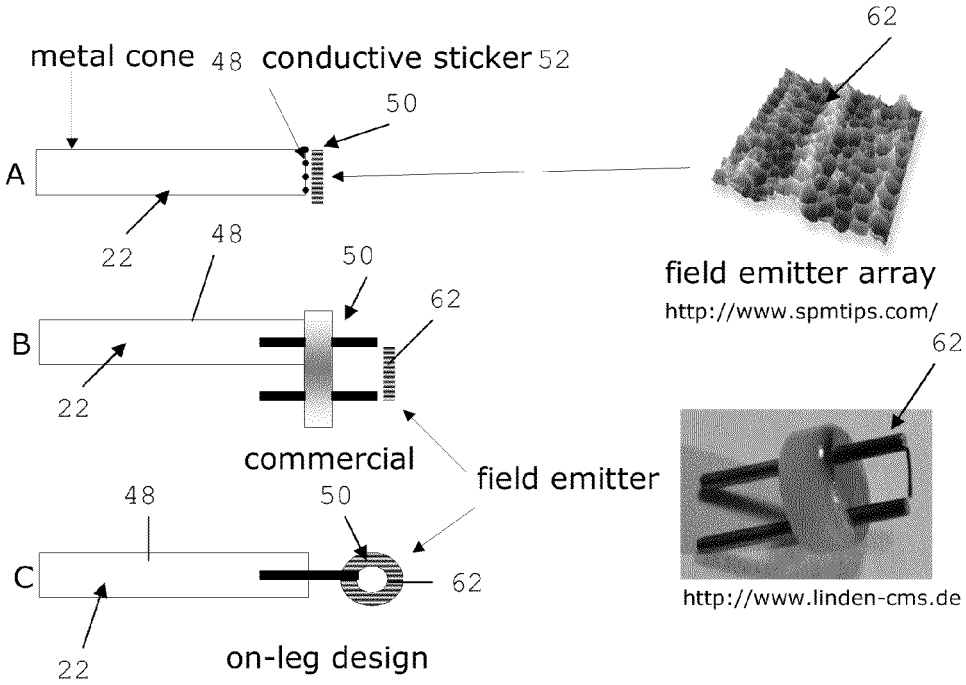
FIG. 8 is a schematic drawing of several field desorption emitters and field desorption arrays.

In order to address these and other issues, the mass spectrometer device comprising an ion source means according to the invention, can generally be composed of, e.g.,:

1. a holding means (sample stage) 22 movable, e.g., in one, two and/or three dimensions (e.g. x, y, and/or z directions) in front of the inlet of the mass analyzer device 14.
2. a conductive, e.g., metal contact 48 to provide a defined electrical potential on the sample holder means 22. The metal contact 48 can be provided on the holding means 22 as part of the holding means 22, like a metal wire, metal layer(s), metal plate, metal cone and/or metal cylinder or any other metal element or elements.
3. optionally, a removable sample target or carrier element which makes contact with the metal on the holding means/stage via, e.g., a stainless steel wire (as described for EST in König, S.; Pales, H. M.; Haegele, K. D. Comment on the cylindrical capacitor electrospray interface. Anal. Chem. 1998, 70, 4453-4455).
4. optionally, cap means 30 or similar devices that are placed onto a mass analyzer entrance capillary 26 and provide a means for improved ion collection efficiency.
5. optionally, a post-ionisation means 47 which ionises molecules emitted from the surface, e.g. by providing a beam of electrons and/or a beam of photons and/or by providing chemical ionisation.
6. optionally, a counter gas means 44 which provides a directed gas flow to assist molecular desorption. Optionally, the gas may be heated. The gas flow may be arranged such that it prevents undesired neutral particles from entering the mass spectrometer.
7. optionally, an air supply means 46 to allow for an additional flow of air or oxygen.
8. optionally, structured sample supports means 50 or emitter means 62, respectively which are provided, e.g., with a structure of microdendrits 10 or "whiskers" 12 or papillaries 17, or pins (e.g., pins of needles), or tips (e.g., tips of syringes), or edges/surfaces of razor blades or the like, or microstructures (e.g., microstructures provided on chips) or nanostructures or wires etc. Such structured sample support means 50 are shown in FIG. 8. The emitter 62 shown in FIG. 8 can be provided with a structure of microdendrites and whiskers similar to that shown in FIGS. 3 and 4 to form the structured sample support means 50.
9. optionally, a closed housing means enclosing for example at least a part of the holding means comprising the sample and at least the entrance of the capillary of the mass analyzer device. Optionally, the closed housing means can be sealed to the surrounding atmosphere if necessary. It can be also sufficient to provide only an enclosure of the sample and the entrance of the capillary without a special sealing function.
10. optionally, a camera means, e.g., a CCD camera or any other suitable camera etc., to control the positioning of a sample next to a capillary or the application on an analyte or analytes on a holding means or emitter means.

The overall dimensions of the inventive ion source means 16 can correspond, e.g., to that of a typical commercial nanospray ESI ion source. Coupling to various types of mass spectrometers where the latter ion sources are routinely used is therefore straightforward.

Due to the fact that all ion sources need to (1) present the sample at a certain distance in front of the mass analyzer,
(2) use an electric field to draw the ions into the mass analyzer, and
(3) optionally use a desolvation gas,
(4) optionally use a post-ionisation means 47
(5) optionally use an additional air-supply means several commercial ion sources provide partial means to allow their transformation into an ion source according to the invention. In particular, often available is (1) an x,y-stage to move the holding means provided with the sample in an x- and y-direction,
(2) an electrical contact, and
(3) optionally a counter gas means
(4) optionally a post-ionisation means 47
(5) optionally an air-supply means
(6) optionally a camera means, e.g., a CCD camera or any other suitable camera Therefore, adapters can be used to transform a commercially available ion source into an ion source means of the invention.

For instance, for the experiments shown below, an atmospheric pressure AP-MALDI source (MassTech/Bruker) and a manual nanospray source (Bruker) were adapted.

Depending on the technical conditions of a particular commercial source (differing by manufacturer), the corresponding adapter means may provide:

a special sample holding means for holding the sample 18 to expose the analyte. In particular, a sample holding means to expose the analyte to FLIE-conditions
special target means to adjust the analyte in z-direction
structured sample support means 50 (provided with, e.g., a microdendrite structure etc.)
special sample preparation comprising, e.g., a micromanipulator provided with, e.g., a magnifying apparatus to facilitate providing a structured sample support comprising, e.g, a microdendrite structure with an analyte without damaging the microdendrite structure cap means 30 or similar devices that are placed onto the mass spectrometer entrance capillary an air supply means 46 for an additional flow of air or oxygen laser means, e.g., an UV or IR laser means etc., for assisting desorption and/or ionisation.

Optical devices including, e.g., optical fibers, mirror means etc., can be used to control the position of the laser focus, its size, the laser beam profile and laser energy per applied pulse on the surface. This set-up can in particular allow an enhanced spatial resolution if desorption is under certain experimental conditions only achieved from spots activated by the laser (e.g. through thermal heating).

Figure 7:
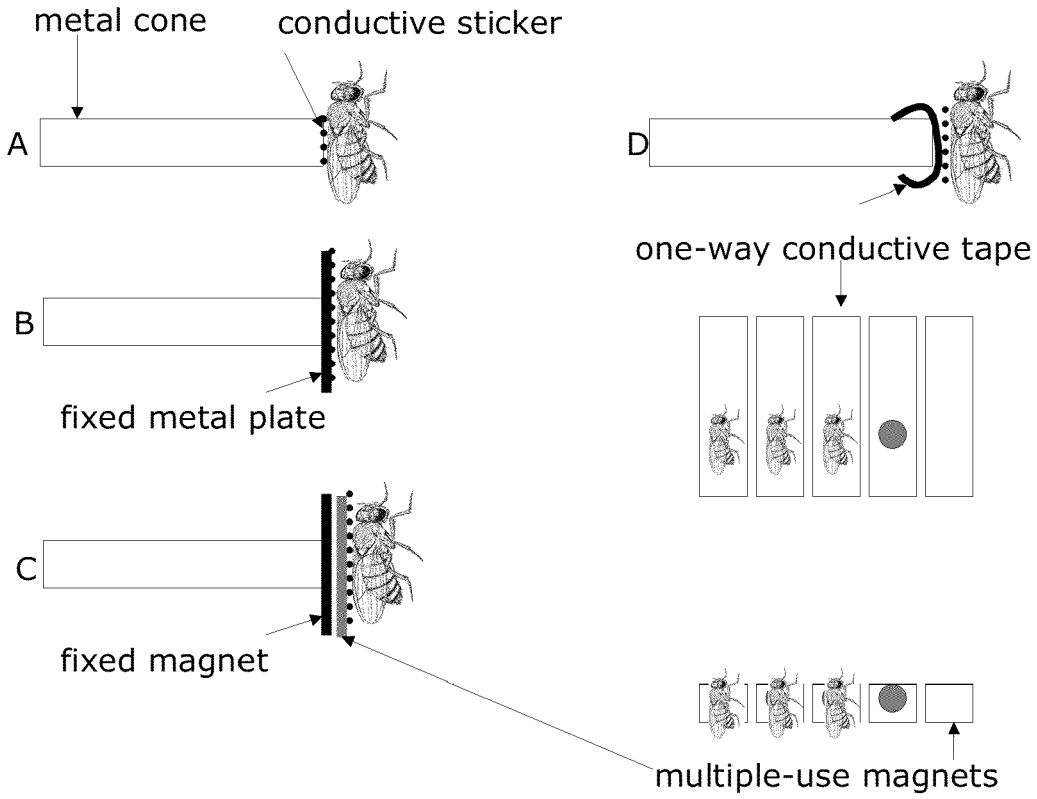
FIG. 7 is a sample preparation for measurement on reusable or one-way holding means.

Further part of the invention, as shown in FIG. 7, is the preparation of living organisms or other sample material either on re-usable or one-way holding means 22. The particular advantage of removable holding means 22 is the possibility of monitoring a living species over certain periods of time switching between measurement and relaxation phases outside the ion source means 16 while the instrument is used for other purposes.

In FIG. 7 a sample preparation for measurement on re-usable or one-way holding means 22 is shown. In one possible embodiment, the sample 18 is, for example, held by a holding means 22 comprising a conductive element, e.g., a metal rod or metal cylinder as metal contact 48 on which a sticker 54 which may be electrically conductive is provided, as shown in Example A of FIG. 7.

A base 52 of the holding means 22 which is provided with the sticker 52 can be enlarged, e.g., by a fix plate 56, for example a metal plate, for better handling, as shown in Example B of FIG. 7. The base 52 of the holding means 22 can be provided with a carrier element 58 which can be fix or removably attached to the holding means 22 or its base 52 or plate 56 by means of a magnet element, as shown in Example C of FIG. 7. The samples 18 are then prepared, e.g., onto magnetic carrier means 58 which will be held by magnetic force during the measurement and which can be removed, e.g., after the measurement has been terminated. This principle as well as the preparation of the sample 18 on small strips of tape 60 which may be conductive, as shown in Example D of FIG. 7, allows better separation in time and space of sample attachment and measurement. In addition, measured samples 18 can be set aside for later re-interrogation or the living organism can be removed from the holding means 22 to its keep/farm.

To provide a carrier element 58 which can be removed from the holding means 22, instead of a magnet element any other connecting means can be provided to removably attach the carrier element 58 to the holding means 22. For example the carrier element 58 and the holding means 22 can be adapted, so that they snap in place and are locked substantially tight (not shown). The carrier element 58 can be provided with, e.g., a protrusion which snaps in a corresponding recess in the holding means or its base or plate and the other way round. However, the examples described before are only two examples of how to adapt the carrier element 58 and the holding means 22 so that the carrier element 58 can be removably attached to the holding means 22. It is obvious for the person skilled in the art that there are several possibilities to removably attach the carrier element 58 to the holding means 22. The present invention is not restricted to the examples pointed out before. In this connection the field emitters 62 in FIGS. 5 and 8 can be provided with a structure, e.g., of microdendrites and/or whiskers or any other microstructure which is suitable to create a local high field strength to form a structured sample support means 50.

Furthermore, the invention involves the discovery that ions can be generated using FBIG-conditions or FLIE conditions, respectively, and commercial field desorption emitters 62 or arrays for ionisation as shown in FIG. 8. This fact extends the use of the inventive ion source means 16 dramatically to the measurement of, e.g., soluble, volatile, and/or gaseous biomolecules from the same or different sources. These field emitters 62 have been developed for other methods such as atomic force microscopy, field desorption/ionisation under vacuum conditions. Their use at FLIE conditions is novel.

Covered by this invention is any type of natural or artificial emitter means 62 with for example nano or fine structure or microstructure which allows the generation of ions at FBIG-conditions or FLIE conditions, respectively. The provision of microdendrites and/or "whiskers" or papillaries as a structure are only three examples among a plurality of structures which allow the generation of ions at FBIG-conditions or FLIE conditions, respectively.

Figure 29A:
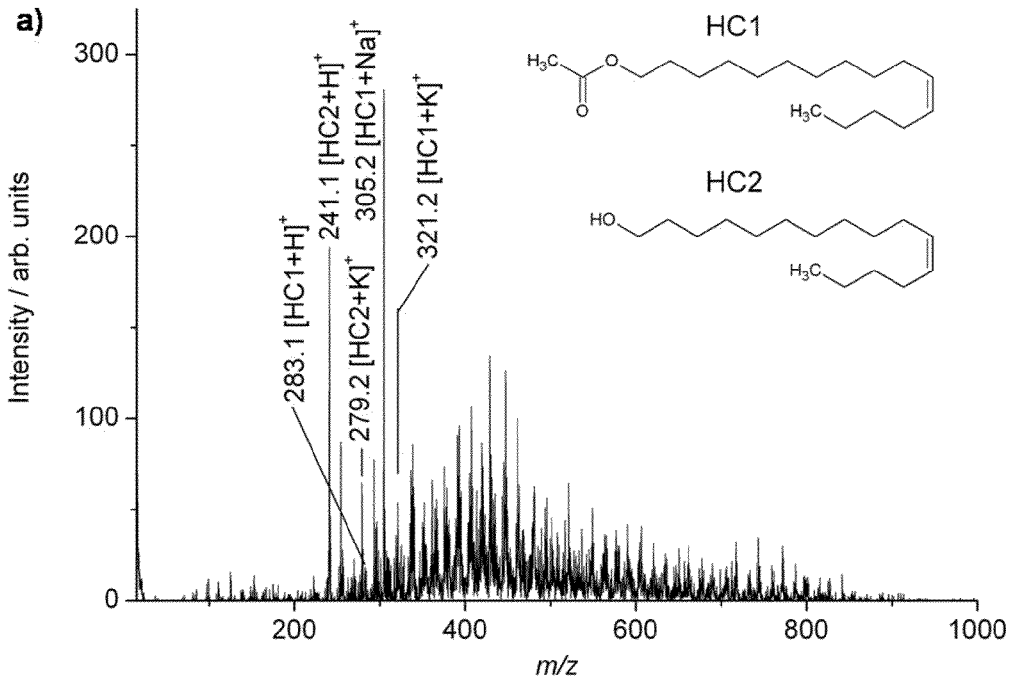
FIG. 29*a* is an ion trap (IT) mass spectrum of solutions of synthetic compounds Z-11-hexadecenyl acetate (HC1) and Z-11-hexadecen-1-ol (HC2) applied to a female fly and measured with field-based ion generation (FBIG)
Figure 29B:
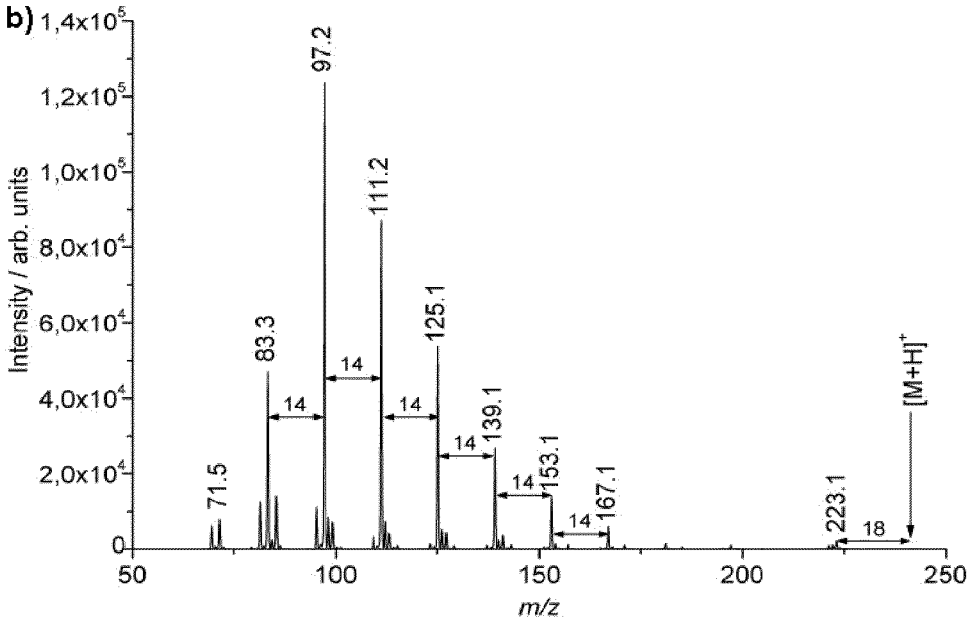
FIG. 29*b* is an APCI-MS/MS spectrum of HC2 applied to a sharp metal tip.
Figure 29C:
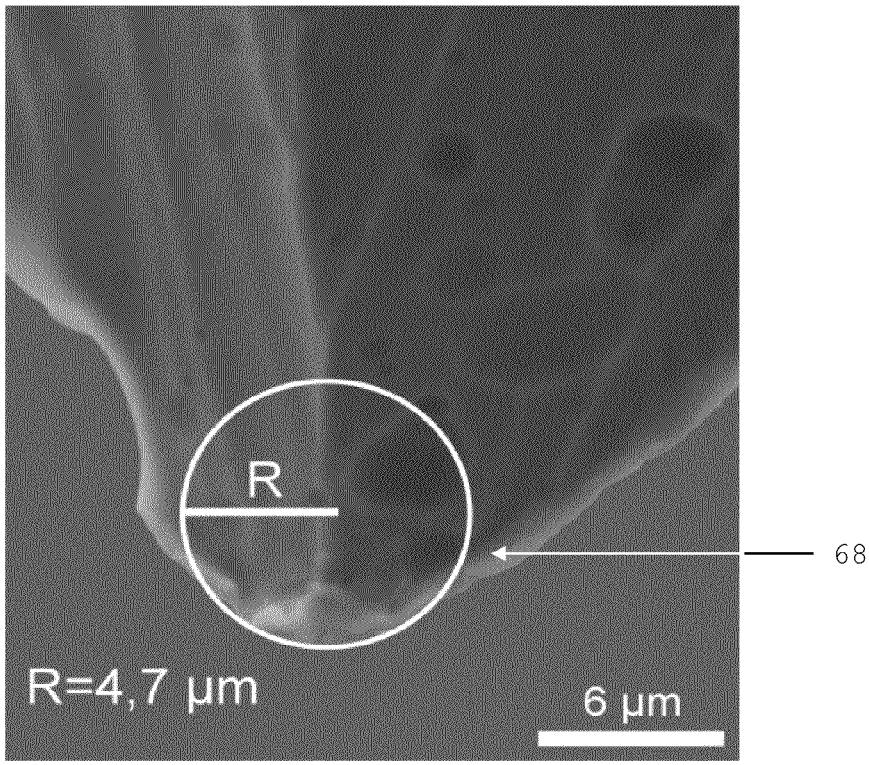
FIG. 29*c* is a scanning electron microscopy (SEM) of a syringe metal tip.

In FIG. 29*c* below, a syringe metal tip 68 is shown which can be used as an emitter means 62, i.e. an artificial emitter 62, as well. A further example of a natural emitter 62 is shown in FIGS. 24, 25, 26 and 27 below, in which a hair 38 of a leg 42 and further a foot 43 of a female fruit fly are shown. Both parts of the fruit fly, i.e., the leg 42 and the foot 43 of the fly, can be used as a natural emitter means 62. Furthermore, chips, e.g., microstructured chips, or pins of needles (e.g. acupunctural needles etc.) or sharp surfaces of razor blades etc. can be used as emitters 62 as well. However, the invention is of course not restricted to these examples.

In FIG. 8 Example A a holding means 22 is disclosed which forms, e.g., a metal cone. At the front, the holding means 22 can be provided, e.g., with a sticker 52 that may be electrically conductive. On the sticker 52 a field emitter array means 62 can be arranged which can be provided with a sample 18 to be analyzed, e.g., a soluble analyte etc. Further in Examples B and C of FIG. 8 the holding means 22 can be provided with a commercial field emitter means 62. In Example C the field emitter 62 comprises a one-leg design. The field emitter 62 can be provided with the sample 18 or analyte to by analyzed by a corresponding mass analyzer device.

Figure 9:
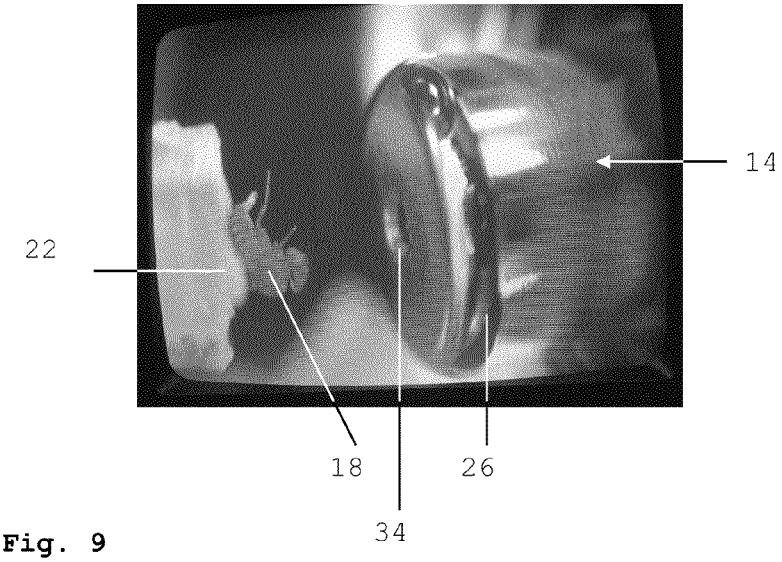
FIG. 9 is a photograph taken from the observation monitor during mass spectrometry measurement according to the invention.

In FIG. 9 a photograph is shown taken from the observation monitor during a mass spectrometry measurement. The entrance capillary 26 of the mass analyzer device 14 is on the right, the holding means 22 provided with the sample 18 is on the left. Movements of the living fly 18 have been documented in short movies. During measurement under FLIE conditions or FBIG-conditions, respectively, the fly 18 emits ions which are absorbed or collected with the entrance capillary 26 of the mass analyzer device 14.

As described before, in case of a living animal, an additional air supply means (not shown) can be provided to supply air or oxygen to the animal to support keeping the animal alive. Further, the ionisation can be supported by using additional means (not shown), e.g. a laser means to assist desorption and desorption/ionisation and to stimulate the sample to emit ions. Furthermore, an additional counter gas means (not shown) can be provided.

In the following examples are shown which were generated using a quadrupole ion trap (Esquire3000, Bruker Daltonik, Bremen) as mass analyzer means 14.

Figure 11A:
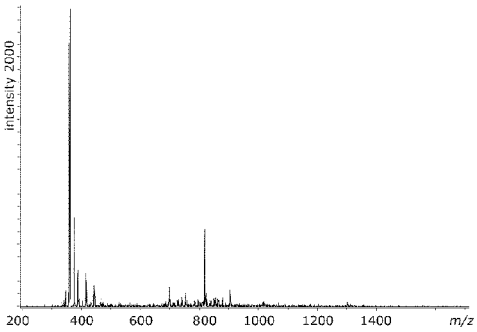
FIG. 11*a-c* are diagrams of mass spectra recorded from differently positioned dead or dissected female flies in positive ion mode.
Figure 11B:
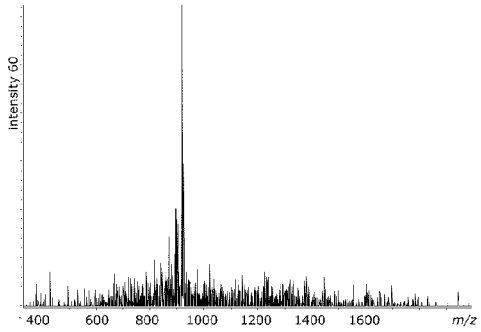
Figure 11C:
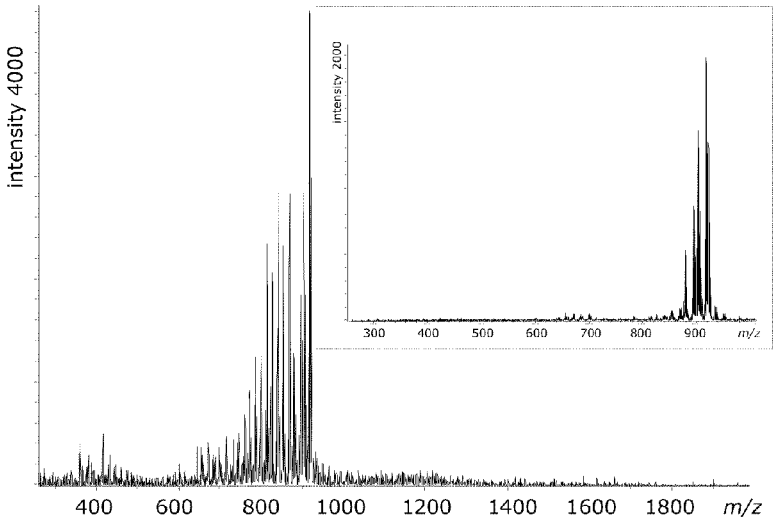
Figure 12:
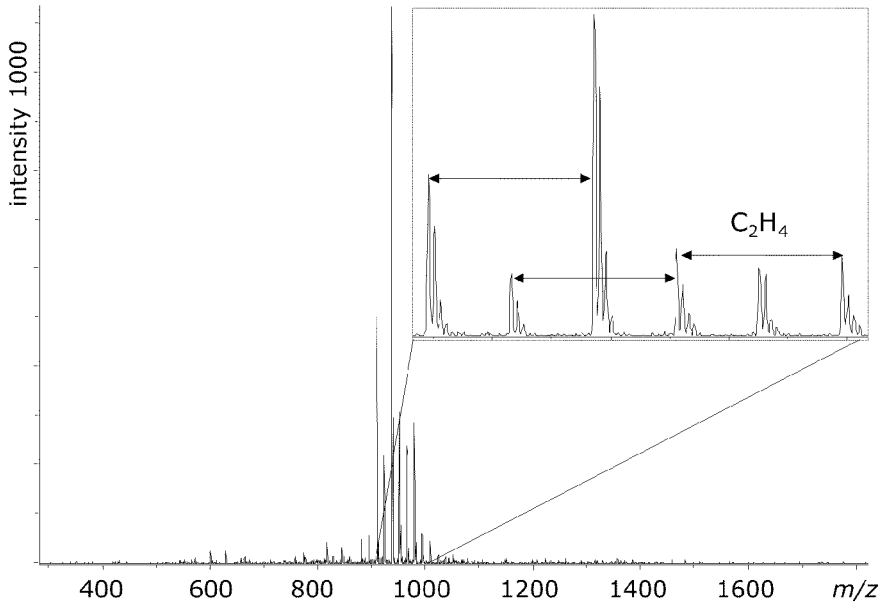
FIG. 12 is a diagram of a mass spectrum recorded from a dead male fly taped to a glass slide in positive ion mode.

First experiments, as shown in FIGS. 10, 11 and 12, using a MALDI sample stage (MassTech/Bruker) showed the need for freedom of movement of the sample stage in the z-direction (not provided for by the MALDI ion source), that means the possibility of moving the sample closer to and away from the entrance capillary of the mass spectrometer as shown, e.g., in FIG. 5. Therefore, a nanospray source was modified according to ref. König, S.; Fales, H. M.; Haegele, K. D. Comment on the cylindrical capacitor electrospray interface. Anal. Chem. 1998, 70, 4453-4455, and the requirements discussed above with respect to FIG. 5.

A high voltage was applied, e.g., on the mass analyzer entrance capillary and varied, e.g., between 1 kV and 4 kV while the holding means (sample stage), was on ground potential. The counter gas flow of the counter gas means was turned on at, e.g., 2-5 l/min or off at a gas temperature that was varied, e.g., from 40-300° C. The position of the holding means, i.e. the sample stage position, was adjusted until a sufficiently high ion signal was obtained. Depending on the measurement conditions the flies either survived the experiment or were killed in the process due to high gas temperatures.

The ion source means (FLIE source) allowed the routine measurement of living fruit flies at 50° C. counter gas flow in negative and positive ion mode and re-interrogation of the flies, surviving the analysis. An additional oxygen flow provided by an air supply means was not necessary in these experiments to ensure the survival of the flies. The observable mass range was set by parameters of the ion optics of the mass spectrometer (e.g. "target mass"). FLIE spectra show ions which partly correspond to ions observed in ESI-MS of hexane or chloroform extracts of flies. Ions are partly associated with phospholipids, triglycerides and hydrocarbons. Potentially, some of the latter function as pheromones. The assignment of all compounds is still in progress.

Figure 16:
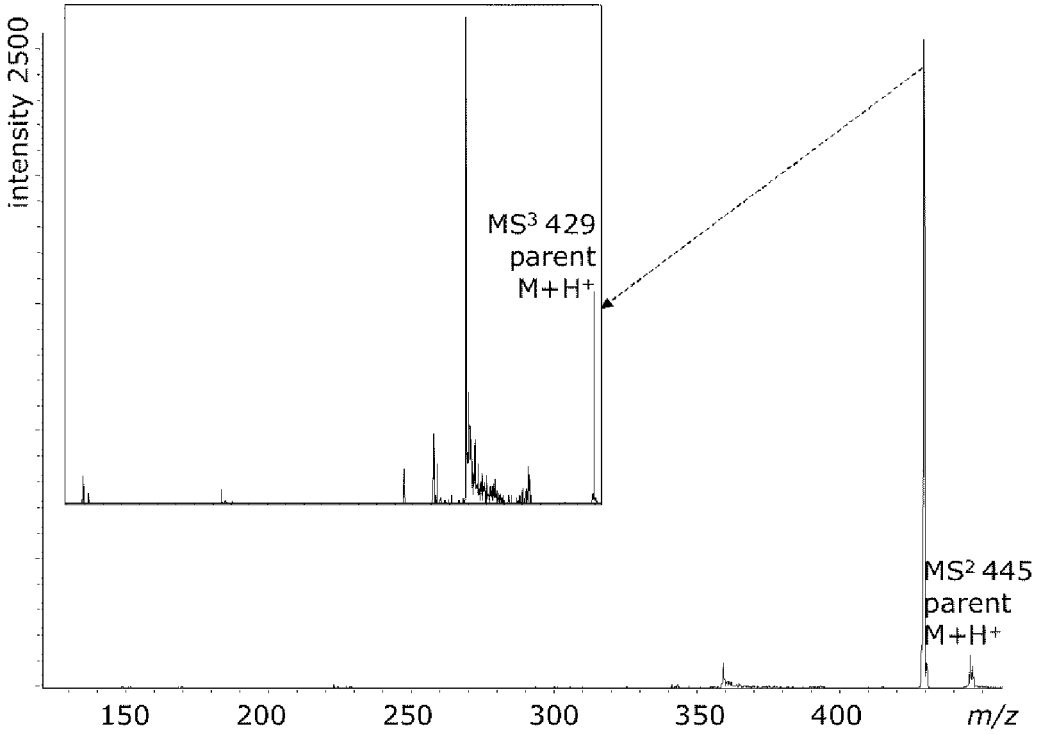
FIG. 16 are diagrams of an MS/MS and an $MS^3$ spectrum recorded from a living female fly in positive ion mode.

In combination with a suitable mass analyzer (like, e.g., the used ion trap means), employment of the inventive ion source means allows structural analysis by collision-induced fragmentation (MS/MS) of selected ions, as shown in FIG. 16. It is obvious to those skilled in the art that also other means of ion fragmentation can be used, e.g., electron-induced dissociation or electron-transfer dissociation or any other method for tandem MS analysis.

Furthermore, in combination with a suitable post-ionisation means ionisation of molecules emitted from the sample under the influence of the high electrical field can be achieved. The use of an artificial emitter under FBIG-conditions or FLIE conditions, respectively, is demonstrated in FIG. 18. Ions of the applied analyte test mixture are clearly visible.

Figure 10A:
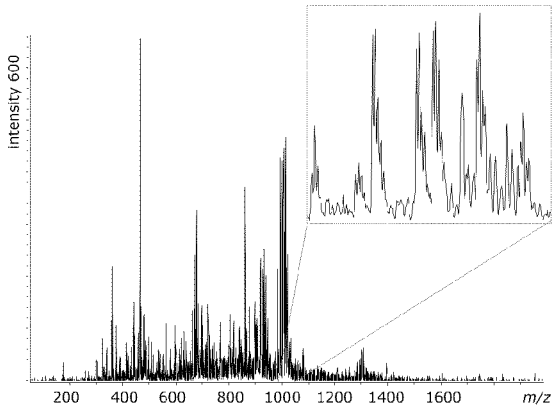
FIG. 10*a, b* are diagrams of mass spectra recorded from living female flies in positive ion mode.
Figure 10B:
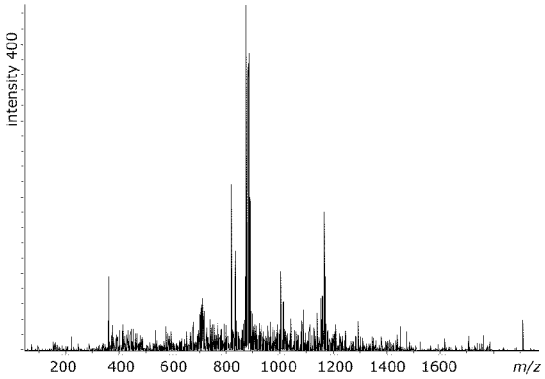

In FIGS. 10*a* and 10*b* FLIE mass spectra (of living female flies are shown (flies were attached to a sample holder of the AP-MALDI stage). The female flies were taped on the back, with their legs up. As counter gas means a flow of $N_2$ gas is provided at a temperature of 50° C. The flies were vigorously moving their legs throughout the procedure and were alive after removal of the sample target from the ion source means and its holding means, respectively. FIG. 10*a* shows the FLIE mass spectrum acquired from an individual insect Fly 1, wherein the potential at the capillary of the ion trap means of the mass spectrometer device is: 2 kV and the ion trap "target mass" is 800. FIG. 10*b* shows the FLIE mass spectrum acquired from an individual insect Fly 2 on a fresh glass slide, wherein the potential at the capillary of the ion trap means of the mass spectrometer device is: 2.5 kV, and the ion trap "target mass" is 900.

Further in FIGS. 11*a* to 11*c* FLIE spectra (MALDI stage) of differently positioned dead or dissected females are shown. The temperature of the counter gas is 50° C. and the potential at the capillary of the ion trap means of the mass spectrometer device is: 2 kV. In FIG. 11*a* a fly is taped on the front/side and its back pointing up into the direction of the capillary. Further in FIG. 11*b* only the fly corpse without its legs is arranged on the holding means. The temperature of the counter gas is 50° C. and the potential at the capillary of the ion trap means of the mass spectrometer device is: 4 kV. In FIG. 11*c* FLIE spectra (MALDI stage) from only the front legs of the fly, attached to the sample holder, are shown. Furthermore the Inset in FIG. 11*c* shows a Fly spectra of only the back legs of the fly. The electrical potential at the capillary of the ion trap means of the mass spectrometer device is: 4 kV.

In FIG. 12 a FLIE spectrum (MALDI stage) of a dead male fly taped to glass slide is shown. The temperature of the counter gas is 300° C. and the potential at the capillary of the ion trap means of the mass spectrometer device is: 4 kV. The distance between the ion signals of 14 u corresponds to $CH_2$ and the distance between the ion signals of 28 u corresponds to $C_2H_4$. These mass differences are characteristic for aliphatic hydrocarbons and lipids.

Figure 13:
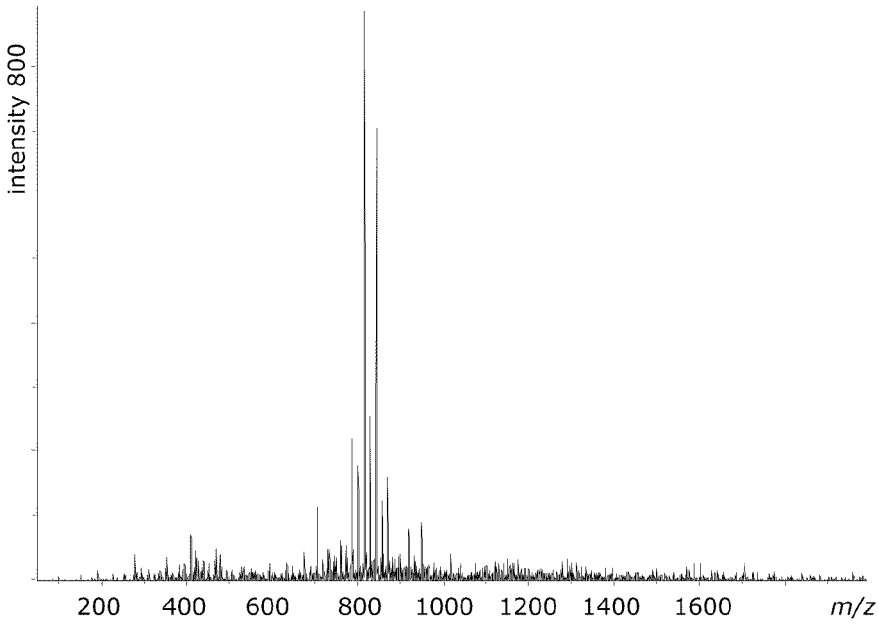
FIG. 13 is a diagram of a spectrum recorded from a living female fly in negative ion mode.

Further, in FIG. 13 a FLIE spectrum of a living female in negative ion mode is shown. The temperature of the counter gas is 60° C. and the potential at the capillary of the ion trap means of the mass spectrometer device is: 3.5 kV. Furthermore, the ion trap "target mass" is 900 and the time for acquisition is 1 min. (length of time of data acquisition).

Figure 14:
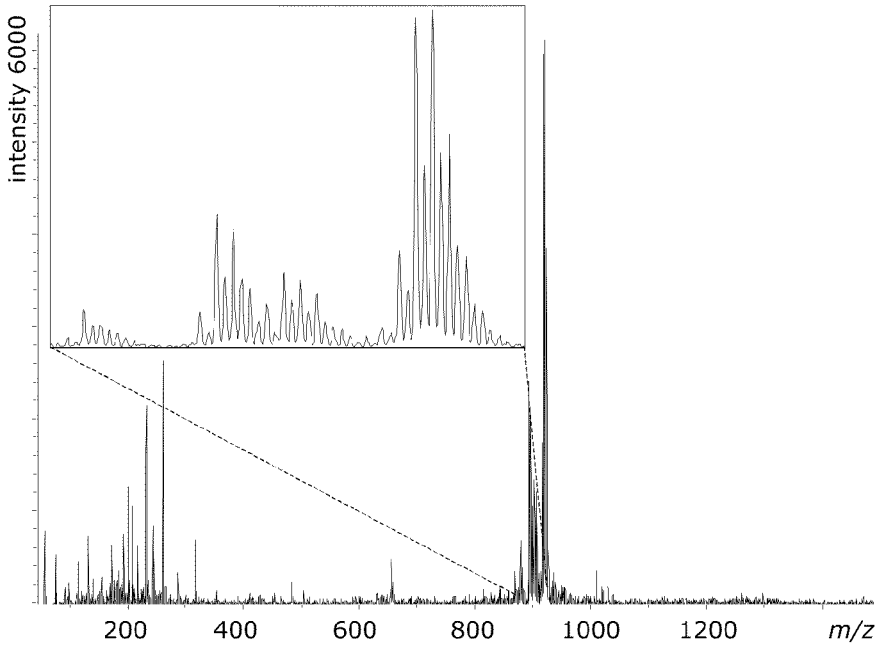
FIG. 14 is a diagram of a spectrum recorded from a dead female fly in positive mode.

In FIG. 14 a FLIE spectrum of a dead female fly in positive ion mode is shown. The temperature of the counter gas is 90° C. and the potential at the capillary of the ion trap means of the mass spectrometer device is: 3 kV. Furthermore, the ion trap "target mass" is 900 and the time for acquisition is 1 min. The inset of FIG. 14*a* further shows a zoom in to major peaks.

Figure 15:
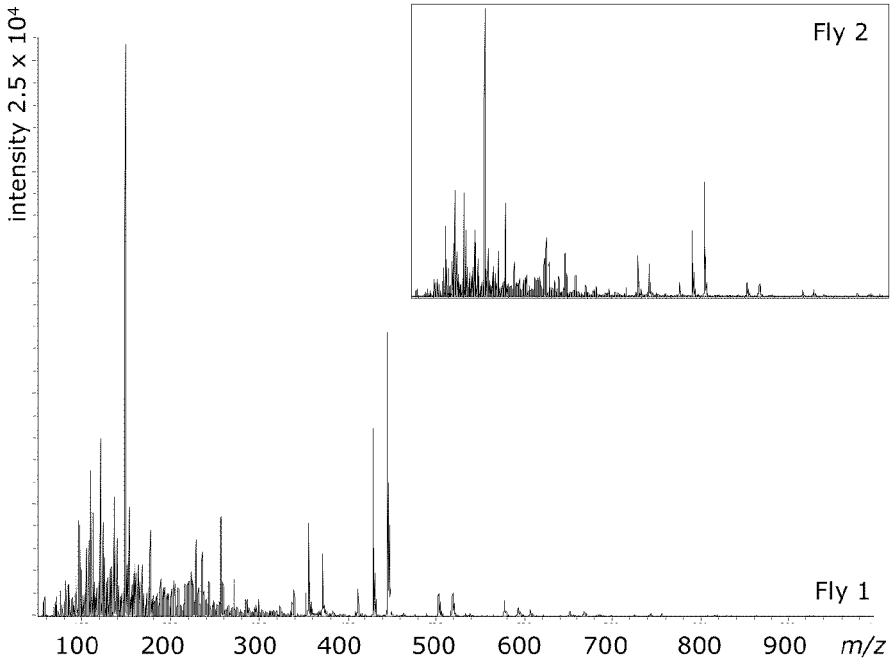
FIG. 15 is a diagram of a mass spectrum recorded from a living female fly in positive ion mode.

In FIG. 15 a FLIE spectrum of a living female fly (Fly 1) in positive ion mode is shown. The temperature of the counter gas is 60° C. and the potential at the capillary of the ion trap means of the mass spectrometer device is: 4 kV. Furthermore, the ion trap "target mass" is 500 and the time for acquisition is 1 min. The inset of FIG. 15*a* further shows a FLIE spectrum (m/z 50-700) of another female fly (Fly 2), wherein the temperature of the counter gas is 80° C. and the potential at the capillary of the ion trap means of the mass spectrometer device is: 4 kV. Furthermore, the time for acquisition is 1 min.

In FIG. 16*a* a FLIE MS/MS spectrum (selected ion at m/z 445.1) of living female flies in positive ion mode is shown. The temperature of the counter gas is 60° C. and the potential at the capillary of the ion trap means of the mass spectrometer device is: 4 kV. Furthermore, the time for acquisition is 1 min. The inset of FIG. 16*a* further shows $MS^3$ on the daughter ion at m/z 429 (range m/z 140-435).

Figure 17A:
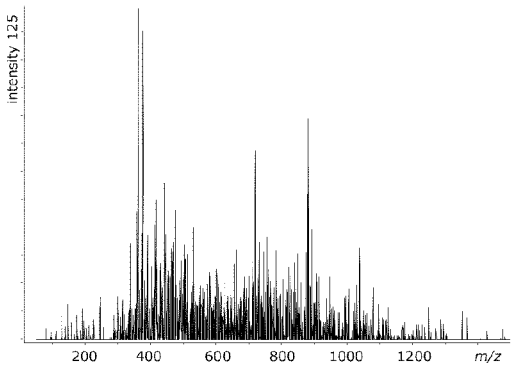
FIG. 17*a-d* is a diagram of a mass spectrum recorded from a 3 day old living flies in positive ion mode.
Figure 17B:
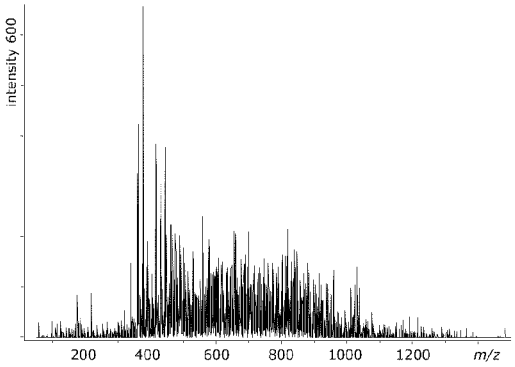
Figure 17C:
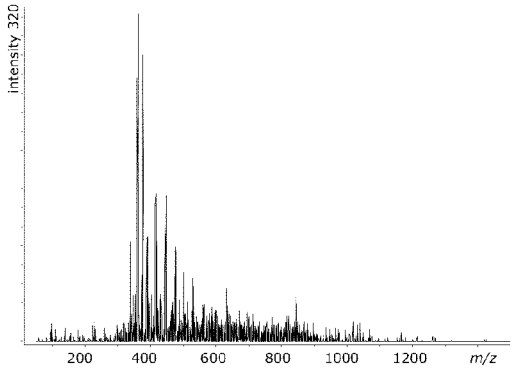
Figure 17D:
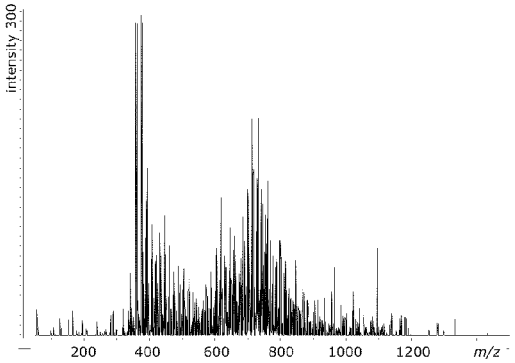

Further, in FIGS. 17*a* to 17*d* FLIE spectra of 3 day old living flies in positive ion mode are shown. The temperature of the counter gas is 50° C. and the potential at the capillary of the ion trap means of the mass spectrometer device is: 3.5 kV. Moreover, the ion trap "target mass" is 500 and the time for acquisition is 0.8 min. In FIG. 17*a* the first female fly is shown, at a time point zero. Further, in FIG. 17*b* the second female fly is shown 48 min after the investigation of the first fly of FIG. 17*a*. In FIG. 17*c* the third female fly is shown 3 h 30 min after the investigation of the first fly of FIG. 17*a*. In FIG. 17*d* further a male fly is shown. The potential at the capillary of the ion trap means of the mass spectrometer device is: 2.5 kV and the time for acquisition is 0.4 min.

Figure 18:
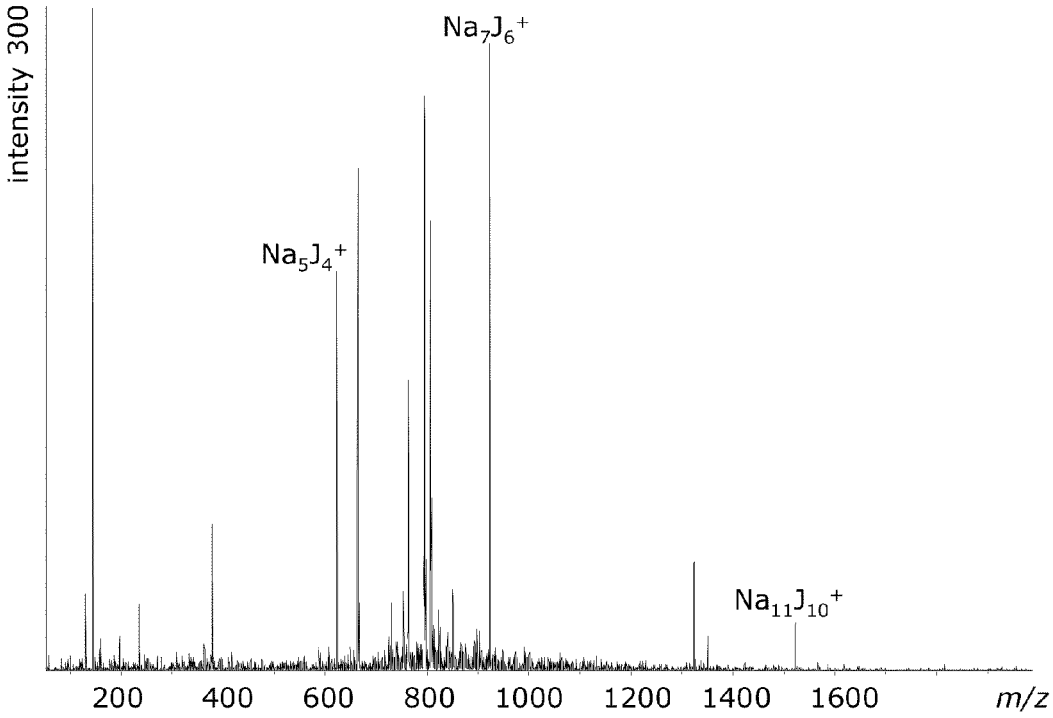
FIG. 18 is a diagram of a mass spectrum of an Esquire tune sample mixture (NaI/CsI) using an FD emitter as shown in FIG. 7.

In FIG. 18 a spectrum is shown taken of an Esquire tune mixture (NaI/CsI) using a Linden emitter as shown in FIG. 8. The tune mixture was applied to the emitter from solution.

Further, the general principle of another inventive ion source means 16 associated to a mass analyzer device 14 to form an inventive mass spectrometer device is depicted in FIG. 19. In the present example as shown, e.g., a gaseous analyte is investigated. However any other analyte, e.g., a liquid analyte, a paste-like analyte and/or a volatile analyte etc. can be investigated as well.

The embodiment of the ion source means 16 as shown in FIG. 19 differs from the ion source means 16 as shown in FIG. 5 in that instead of a structured sample 18, i.e., a fruit fly, a structured sample support means 50 is used which can support ionisation and/or desorption of the sample 18, in the present case a gaseous sample 18.

In FIG. 19 an embodiment of the inventive ion source means 16 is disclosed which is coupled to one example of a mass analyzer device 14. It has to be noted, that the invention is not restricted to a mass analyzer device 14 as shown in FIG. 19. The embodiment shown in FIG. 19 is only exemplary and the inventive ions source means 16 can be also used in connection with a plurality of other mass analyzer devices of a mass spectrometer device. Furthermore, the ion source means 16 can be also used independent of a mass analyzer device 14. Moreover, the inventive ion source means 16 can be also used in connection with a gas-phase chromatograph (not shown) etc.

As shown in FIG. 19, the ion source means 16 comprises at least one or a plurality of structured sample support means 50. In the present case, a structured sample support means 50 is provided which is located on a holding means 22 of the ion source means 16 and which can be brought in contact with an analyte or analytes as sample 18 to be investigated. Such a structured sample support means 50 comprise a structure or structures which can support desorption/ionisation of ions of the sample 18 to be investigated. The sample 18 can be for example an analyte or a plurality of analytes to be investigated.

In the present example as shown in FIG. 19 a gaseous analyte is investigated, for example the breath of a human being. However, any other analyte or combination of analytes can be investigated such as for example, a volatile analyte, a liquid analyte and/or a paste-like analyte etc.

Examples of structured sample support means 50 have been described before with respect to FIGS. 3, 4 and 8. The description of the structured sample support means 50 will be therefore not repeated.

The holding means 22, on which the structured sample support means 50 is positioned, can be fix or can be adapted to be movable or adjustable, respectively, in one, two or three dimensions, e.g., along the x-, y- and/or z-axis as shown, exemplary, in FIG. 19. This allows an optimisation of the ion signal. Further, a spatially-resolved analysis can be achieved by moving the structured sample support means 50 in an optimal position relative to a counter electrode. In the embodiment shown in FIG. 19 this counter electrode forms, e.g., the entrance capillary 26 of the mass analyzer device 14. In the example in FIG. 19 the capillary 26 is arranged, e.g., substantially opposite to the holding means 22 and its structured sample support means 50 to collect ions emitted from the sample 18 or ions that optically generated from molecules emitted from the sample 18 by a post-ionisation means 47. This post-ionisation means 47 as indicated by the dashed line in FIG. 19 is an optional feature and can be used to further support ionisation of the sample 18.

As described before, the invention concerns on the one hand the desorption of ions from a sample or samples to be investigated. Further, the invention also concerns the aspect that ions can not only be desorbed from the sample when they already exist as ions in the sample but can be also desorbed/ionised (i.e. desorbed and ionised) from the sample. In the latter case of the direct generation of ions from uncharged molecules the processes of desorption and ionisation are intertwined and is summarized as desorption/ionisation throughout the description as stated above. Optionally, an additional post-ionisation means 47 can be provided to assist ionisation of molecules as described before.

In one embodiment not shown in FIG. 19 but described with respect to FIG. 5, the entrance 28 of the capillary 26 can be provided with an additional cap means 30, as shown in FIG. 5, including, e.g., at least one opening or at least one tube element 32 extending from the cap means 30 to collect ions emitted from the structured sample support means 50 and the sample 18. The cap means 30 can provide opening(s) 34 with variable diameter and geometry. However, the cap means 30 can be provided on any other collecting means to collect ions from the structured sample support means 50 and the sample 18. The invention is not restricted to a capillary 26 as a collecting means to collect ions. In principle, the cap means 30 can be provided on any other collecting means which collects ions from the structured sample support means 50 and the sample 18. However, in the present case as shown in FIG. 19, in which a gaseous analyte is investigated as sample 18 the cap means 30 can be also omitted.

To emit molecules and/or ions from the sample 18 an electrical field is generated by the application of a voltage difference between the holding means 22 holding the structured sample support means 50 and a counter electrode 26. When investigating the sample 18, for example a gaseous sample 18 as the breath of a human being, this sample 18 is brought into contact with the structured sample supporting means 50. As shown in FIG. 19, a flow of the gaseous sample 18 or gaseous analyte is directed towards the structured sample support means 50 to come into contact with the structured sample support means 50.

The counter electrode to which a voltage can be applied, can for instance be formed by the transfer capillary 26 of the mass analyzer device 14. However, any other counter electrode can be used instead depending on the function and purpose. The invention is not restricted to the transfer capillary 26 as counter electrode, this is only one example among a plurality of possibilities.

A high voltage difference in a range, e.g., between positive or negative 1 kV to 4 kV can be applied to the counter electrode 26 while the holding means 22, i.e., the sample stage, is at ground potential. On the other hand, the voltage in a range between, e.g., positive or negative 1 kV to 4 kV can be also applied to the holding means 22, while the counter electrode, which can for instance be formed by the transfer capillary 26 of the mass analyser device 14, is at ground potential.

It has to be noted that the range of positive or negative 1 kV to 4 kV is only exemplary and the invention is not restricted to this exemplary range. The voltage difference can be also less than 1 kV or larger than 4 kV and can be constant or variable and can also be varied in a temporal fashion. Furthermore, the height of the voltage is selected, e.g., so that a suitable voltage difference between the holding means 22 and the counter electrode can be achieved, so that ions and/or molecules can be emitted from the sample 18.

In the present case, a locally high field strength can be generated by the presence of the surface structure of the structured sample support means 50, such as for example microdendrites 10 and/or whiskers 12 and/or at least one or a plurality of pins (e.g. pins of needles) and/or at least one or a plurality of tips (e.g. tips of syringes) and/or at least one or a plurality of edges or sharp surfaces (e.g. edges or sharp surfaces of razor blades) and/or least one or a plurality of microstructured chips and/or at least one or a plurality of wires etc. as shown, e.g., in FIGS. 3, 4 and 8. The structured sample support means 50 provided with such a structure, e.g., of microdendrits 10, or whiskers 12, or papillaries 17 or pins or tips or edges or microstructures or nanostructures, or wires etc. can be brought into contact with the sample 18 to be investigated by directing a flow of the gaseous sample 18 to the structured sample support means 50. In case of a liquid sample, the liquid sample can be for example dropped or sprayed onto or in direction of the structured surface of the structured sample support means 50.

In addition, the structured sample support means 50 and at least the entrance 28 of the capillary 26 of the mass analyzer device 14 can be enclosed by a closed housing means 64 to avoid for example a contamination of the sample 18 or any other unintended influence from outside on the sample 18. The closed housing means 64 can be provided with an inlet 66 to direct a flow of, e.g., a volatile and/or gaseous sample 18 into the closed housing means 64 and to the structured sample support means 50. For example the breath of an animal or human being can be directed into the closed housing means 64 and to the structured sample support means 50. Furthermore, the closed housing means 64 can be provided with an outlet (not shown) for example to remove the gaseous sample 18 or to remove any impurities inside the closed housing means 64 by cleaning the closed housing means 64, e.g., by directing a flow of counter-gas ($N_2$) through the closed housing means 64 before directing a flow of the gaseous sample 18 into the chamber 64. It has to be noted, that the closed housing means 64 does not necessarily have to be sealed to the atmosphere outside. But of course the closed housing means 64 can be sealed if necessary. Further, the closed housing means 64 can optionally provided with a pressure regulating means (not shown) to regulate the pressure inside and/or with a temperature regulating means (not shown) to regulate the temperature inside. This has the advantage, that a defined pressure such as atmospheric pressure AP can be provided inside the closed housing means 64 or any other pressure. Furthermore, a defined temperature or temperature variation can be provided inside the closed housing means. Preferably the closed housing means 64 is transparent and out of plastic and/or glass. However, the invention is not restricted to these examples of a closed housing means 64 enclosing the sample 18 and the structured sample support means 50.

It has to be noted that the additional closed housing means 64 is an optional means. In case, e.g., a gaseous sample is investigated which desorbs for example molecules which are not included in the surrounding atmosphere, so that the surrounding atmosphere does not have a substantial influence on the result of the investigation of the gaseous sample, the closed housing means 64 can be omitted. However, this is only one example where the closed housing means 64 can be omitted. The invention is not restricted to this particular example. As can be further derived from FIG. 19 optionally an additional counter gas means 44 (indicated by an arrow in FIG. 19) can be provided, which supplies a counter gas flow, e.g., from the entrance 28 of the mass analyzer device 14 opposite of the sample 18. Such a counter gas flow is used for example to prevent solid or neutral material from entering the mass analyzer device 14. Further, such a counter gas flow can be used to potentially assist the desorption of analyte molecules and ions and desorption/ionisation of ions or even forms a prerequisite. In the example shown in FIG. 19, nitrogen counter gas is used. It is obvious for the skilled person, that instead of nitrogen gas any other suitable gas can be used. The counter gas can be further adjusted to assist, e.g., the ion generation.

As described before, optionally at least one or more additional post-ionisation means 47 can be provided to ionise molecules, e.g. neutral molecules, desorbed from the sample 18. Such an additional post-ionisation means 47 is indicated by the dashed line in FIG. 19. In a further variant such a post-ionisation means 47 can also be provided after collection of molecules e.g. by a directed gas flow through a collecting capillary. As a post-ionisation means 47 a beam of electrons, photons or ionising chemicals can be used with the ion source means 16. In particular, a post-ionisation means 47 can be based for example on a APCI, APPI, EI, or EESI method and can be applied to ionise molecules emitted from the sample, e.g., a gaseous analyte.

The design of the ion source means 16 comprising the holding means 22, the structured sample support means 50 and the sample 18, e.g., a gaseous analyte, accommodates the invention that ions and/or molecules are emitted by the gaseous analyte when the gaseous analyte is brought into contact with the structured surface of the structured sample support means 50 and further the gaseous analyte is exposed to an electric field. The mechanism of desorption/ionisation is currently under investigation as stated before.

In case ions are generated from a sample 18, e.g., a gaseous analyte, the inventors have furthermore discovered that an additional electrospray means or nanospray means or any other means assisting desorption and ionisation (not shown), respectively, to generate ions and/or molecules is not necessary. However, an electrospray means or nanospray or other means can be used of course optionally to assist ionisation, but it is not essential. Optionally, a stream of gas containing excited gas molecules, e.g., He, and ionised water clusters can be used to assist desorption and/or ionisation of the sample 18 to be investigated.

Moreover, additional laser means (not shown) to assist desorption of molecules and ions and/or desorption/ionisation of ions like, e.g., ultraviolet (UV) and infrared (IR) lasers etc. to create ions and/or molecules are also not necessary. However, they can be used optionally to assist ionisation.

Furthermore, the sample 18 in FIG. 19 can be investigated under atmospheric pressure AP or substantially atmospheric pressure according to the invention.

In the embodiment of the ions source means 16 as shown in FIG. 19 a structured sample support means 50 is used, where the structure or structured surface of the structured sample support means 50 assist in desorption/ionisation of molecules of, e.g., a gaseous analyte. However, it is of course also possible to use instead or in addition to the structured sample support means 50 for example an animal or plant or any other biological and/or artificial material with a structure or structured surface which is able to assist desorption/ionisation of a sample 18 such as, e.g., a gaseous, liquid, solid, paste-like and/or volatile analyte.

Figure 20:
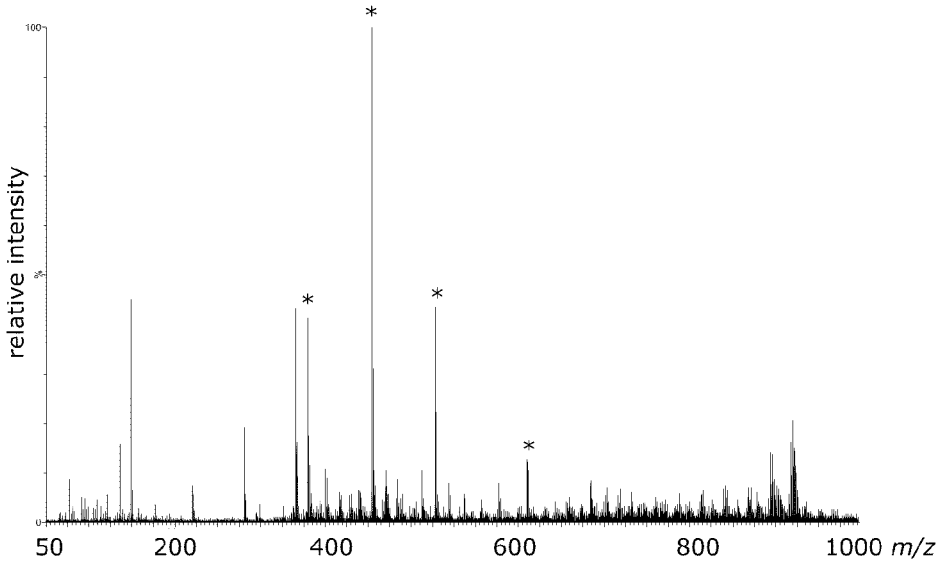
FIG. 20 is a diagram of a mass spectrum investigating a living female fly.

Further, in FIG. 20 a diagram is shown of a mass spectrum recorded from a living female fly. It could be shown, that abovementioned microstructures support ionization of gaseous compounds when an electric field is applied. For instance, common contaminants from laboratory air have been identified in FLIE spectra as shown in FIG. 20 and further in FIG. 21. Those were detected either protonated or as molecular ions. Therefore, the use of the FLIE source extends to volatile or gaseous samples such as breath, fumes, exhaust etc. For those investigations, the source may be modified to present for example the gaseous samples in a closed chamber (closed housing means) or special influx to avoid contamination from the laboratory air.

In FIG. 20 a FLIE spectrum from a living female fly is shown which is obtained on a Q-TOF Premier mass spectrometer. No counter gas was used. Further, an electrical field of, e.g., 3 kV was applied to a modified nanospray source holding a FLIE adapter. The fly was living throughout the procedure and could be interrogated repeatedly. Some of the major compounds (starred) were fragmented and were identified as silicone contaminants from the ambient air as detailed below.

In following Table 1 expected electron impact ions for common silicone contaminants in laboratories are shown (see also K. Biemann, in Mass Spectrometry, Organic Chemical Applications, McGraw-Hill Book Company, New York, 1962, pp. 171-172).

TABLE 1

| n | Structure A | Structure B | Structure C |
|---|---|---|---|
| 0 | 133.014 | 118.998 | 73.047 |
| 1 | 207.033 | 193.017 | 147.066 |
| 2 | 281.052 | 267.036 | 221.085 |
| 3 | 355.070 | 341.055 | 295.104 |
| 4 | 429.089 | 415.074 | 369.123 |
| 5 | 503.108 | 489.092 | 443.142 |
| 6 | 577.127 | 563.111 | 517.161 |

(the numbers denote calculated m/z values of expected ions)

Structure A

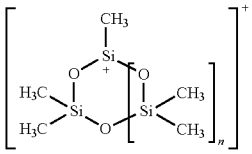

Structure B

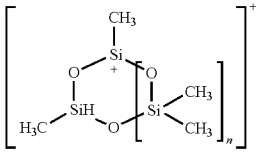

Structure C

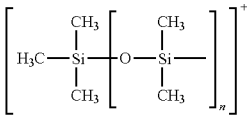

$n = 0, 1, 2, 3 \ldots$

Figure 21:
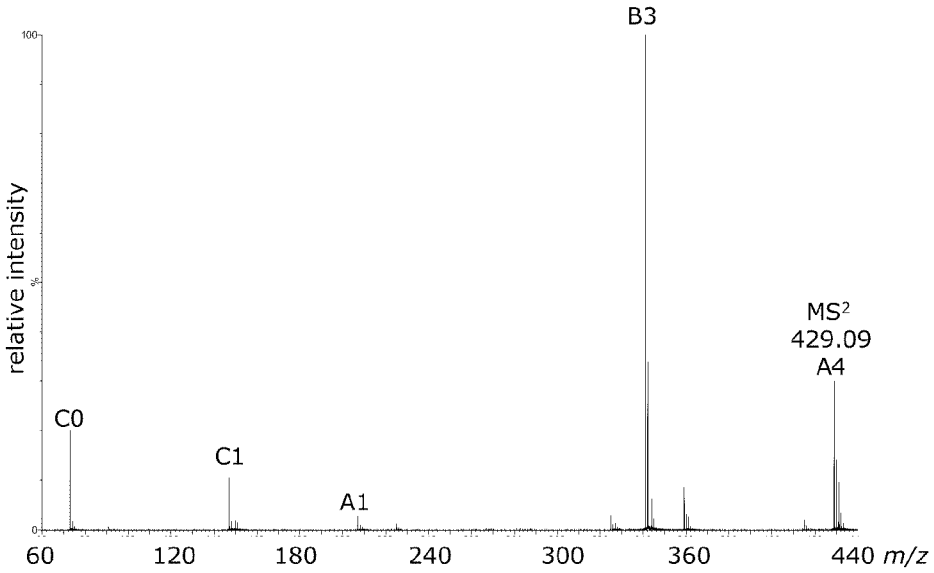
FIG. 21 is a diagram of an MS/MS spectrum recorded investigating a fly (m/z 429.09)

In FIG. 21 a diagram of an MS/MS spectrum is shown recorded while investigating a fly (parent ion at m/z 429.09). Therein, structures C0, C1, A1 and in particular structures of B3 have been found.

Figure 22:
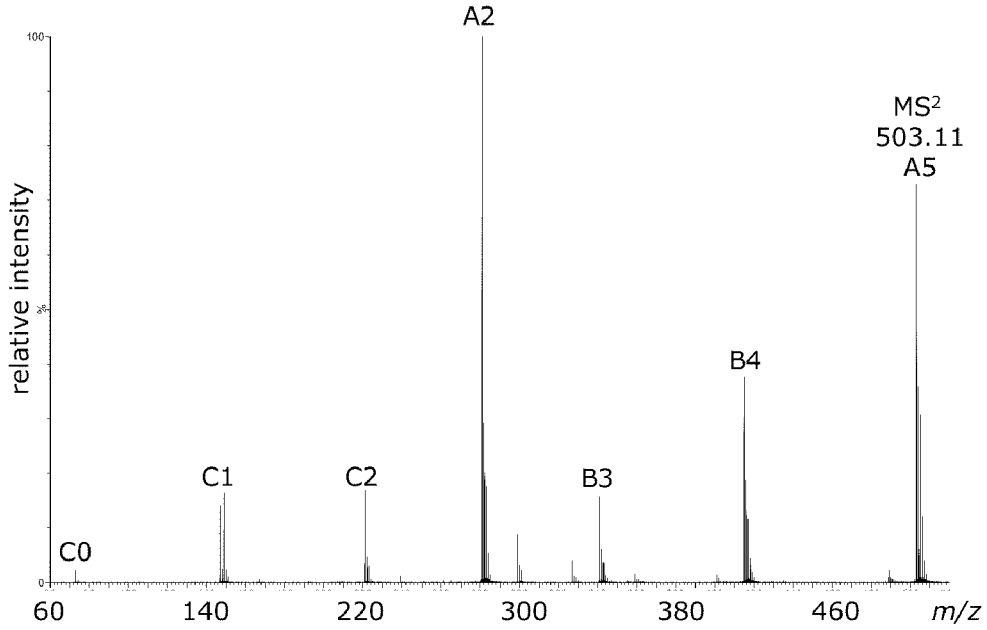
FIG. 22 is a diagram of an MS/MS spectrum investigating a fly (m/z 503.11)

Further, in FIG. 22 a diagram of an MS/MS spectrum recorded while investigating a fly (parent ion at m/z 503.11) is shown. In this case, structures C0, C1, C2, B3, B4 and in particular A2 have been found.

Figure 23:
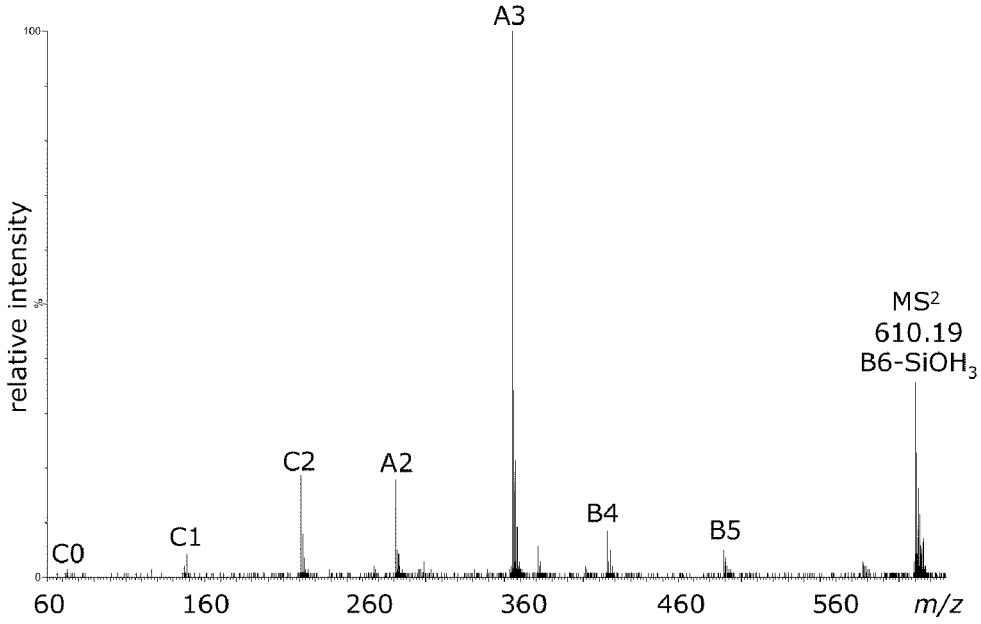
FIG. 23 is a diagram of an MS/MS spectrum investigating a fly (m/z 610.19).

Furthermore, in FIG. 23 a diagram of an MS/MS spectrum is shown recorded while investigating a fly (parent ion at m/z 610.19). Therein, also structures C0, C1, C2, A2, B4 and B5 have been found which are due to contaminants in the air of the laboratory, where the fly has been investigated.

As pointed out before, FIG. 6*a* shows a part of a fly leg of a fruit fly. In experiments flies and different body parts of the flies were dissected and measured using an experimental set-up as shown, e.g., in FIG. 5 or 19. FIG. 5 shows one schematic example of the general design of an FBIG source using, e.g., an adapted nanospray source. For the investigation of living fruit flies, the insects were taped to a holding means and exposed to an electric field maintained between the holding means and the entrance capillary of the mass spectrometer or mass analyzer device, respectively. In other experiments, the flies were replaced by microstructured artificial emitters (e.g., a sharp tip or a classical field-emitter), allowing analysis of samples applied to these surfaces.

Results of the experiments are shown, e.g., in the following in FIGS. 28, 29*a*, 29*b*, 29*c*, and FIGS. 30 to 36.

In addition to FIGS. 6*a* and 6*b*, FIGS. 24, 25, 26 and 27 show further scanning electron micrograph images of parts of a fruit fly.

For scanning electron microscopy the fruit flies were mounted, e.g., on aluminium specimen stubs as sample holding means with electrically conductive carbon (Plano) and subsequently rotary shadowed with 3 nm Pt/C at an elevation angle of, e.g., 65° to obtain sufficient electric conductivity at the surface. Secondary electron micrographs were taken with an "in-lens" type S-5000 high-resolution field-emission scanning electron microscope (Hitachi Ltd., Tokyo, Japan) at 30° c.

Figure 24:
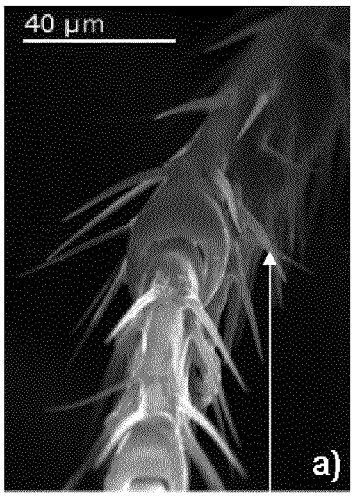
FIG. 24 is a scanning electron micrograph image obtained from a knee or femoro-tibial joint of a female fruit fly *Drosophila melanogaster;*

FIG. 24 shows a scanning electron micrograph image obtained from a femoro-tibial joint of a fruit fly Drosophila melanogaster.

Figure 25:
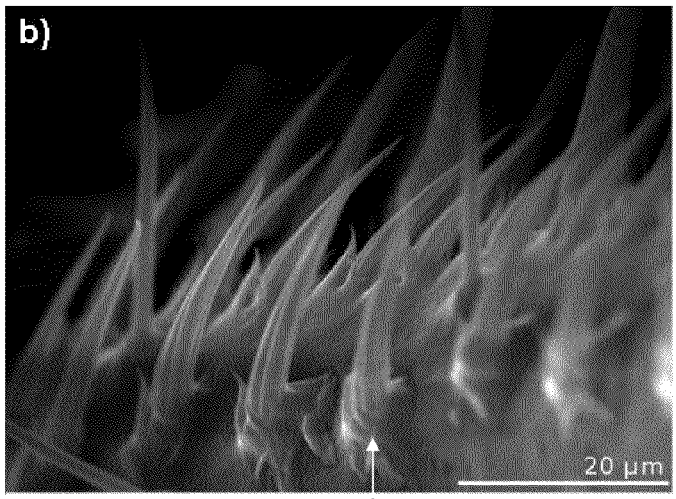
FIG. 25 is a scanning electron micrograph image obtained from a leg of a female fruit fly *Drosophila melanogaster;*

Further, FIG. 25 shows a scanning electron micrograph image obtained from a leg 42 of a fruit fly Drosophila melanogaster.

Figure 26:
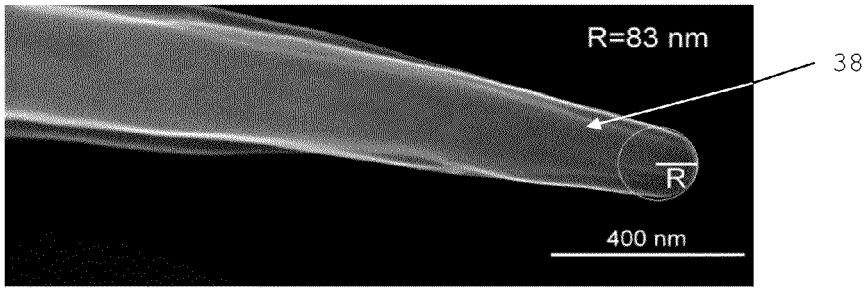
FIG. 26 is a scanning electron microscopy (SEM) of a hair from a leg of a female fruit fly.

In FIG. 26 a scanning electron micrograph image obtained from a hair 38 of a leg of a female fruit fly is shown, for the determination of the radius of the tip of the hair.

Figure 27:
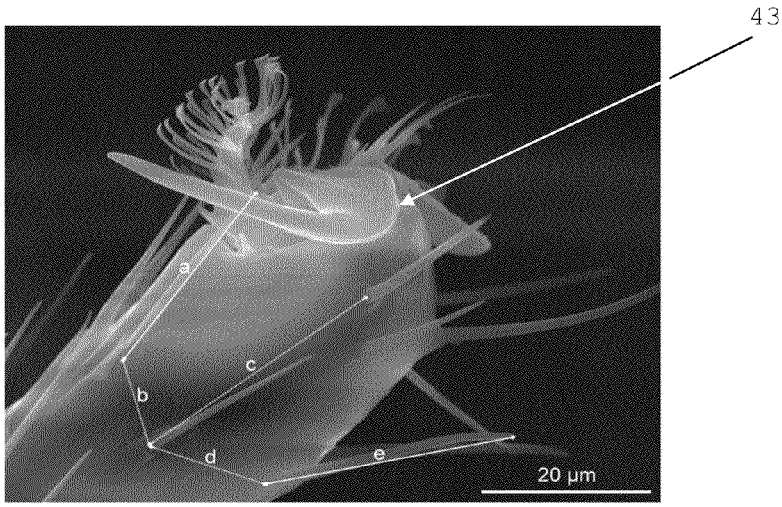
FIG. 27 is a scanning electron microscopy (SEM) of a foot from a female fly.

FIG. 27 further shows a scanning electron micrograph image of a foot 43 of a female fly for the determination of, e.g., the parameters a to d. The result of the measurement of the parameters a to d is as follows: a=27.0 μm; b=12.2 μm; c 32.5 μm; d=15.1 μm; e=30.4 μm.

The scanning electron microscopy of flies or part of flies as shown in FIGS. 24 to 27, revealed the presence of tiny hairs on the fly body, but in particular on the legs as shown in FIGS. 24 and 25. These hairs were spaced at, e.g., about 10-25 μm distance, the radius at the tip was about 80 nm and they were about 25-30 μm in length.

It has been found out in tests that such microstructures, as shown exemplary in FIGS. 6*a*, 6*b* and FIGS. 24 to 27, influence ionization.

To analyze cuticular hydrocarbons (HCs) from living insects by scanning the cuticle with a laser, an AP-IR-MALDI source means in conjunction with an ion trap (IT) mass spectrometer means has been used. The ion trap measurements were first performed using the AP-MALDI source. In this connection, the flies were taped on their backs (wings) to MALDI targets. Ions were emitted from the fly when it was exposed to an electric potential difference as is typically used for AP-UV-MALDI (e.g, about 2.5-3.5 kV). Laser irradiation was not applied, but a heated counter gas flow of nitrogen from the ion trap was optionally used although it was not critical or absolutely necessary, respectively.

Remarkably, ions were generated from the insects solely under the influence of the electric field generated between a MALDI sample plate, on which the animals were mounted, and the counter electrode on the instrument. This observation is referred to by using the term field-based ion generation (FBIG) as stated above. The generation of locally high electric field strengths at the sharp tips of the hairs 38 on the insect body, as they are shown, e.g., in FIGS. 24 and 25, plays a key role in ion formation.

To explore this finding in more detail a series of experiments using both IT and quadrupole time-of-flight (Q-TOF) mass spectrometry means have been performed. In order to enable greater precision in the positioning of the fly in three dimensions, the nanoESI sources of both mass spectrometer means were modified. The reason was that the MALDI stage allowed movement only in x and y direction in front of the ion trap entrance capillary. For the investigation of specimens of different sizes it might be even better to move the specimens not only in two dimensions but in three dimensions.

Therefore, the Bruker nanoESI source for manual operation was modified. This stage allowed for fine control of the fly position and could be adapted to different kinds of sample holders such as double-sided tape, snap-in-place connectors or magnets.

The general layout is depicted, e.g., in FIG. 5. Normally, a stream of nitrogen from the mass spectrometer entrance accompanies measurements on these instruments. Field-based ion generation (FBIG) does not require gas flow for ion emission. However, the gas stream can be used optionally to avoid contamination of the analyzer. When a lower gas temperature of, e.g., 30-45° C. was used, the animals lived through the length of the measurement. Under such conditions, successive mass spectrometric interrogation of living insects with intermittent breaks was possible. For analysis using the Q-TOF Premier instrument, an adapter using the nanospray-online source was built. This configuration allowed the fly to be positioned, e.g., about 2 mm next the opening of the entrance cone. As with the ion trap (IT), the intensity of different ions can be influenced by instrumental parameters, such as the quadrupole RF voltages. In this case, settings were chosen which allowed transmission and detection of ions up to m/z 2000. The instrument was calibrated for example with Glufibrinopeptide fragment ions immediately before measurement so that a mass accuracy better than 10 ppm could be expected up to m/z 1300.

Figure 28:
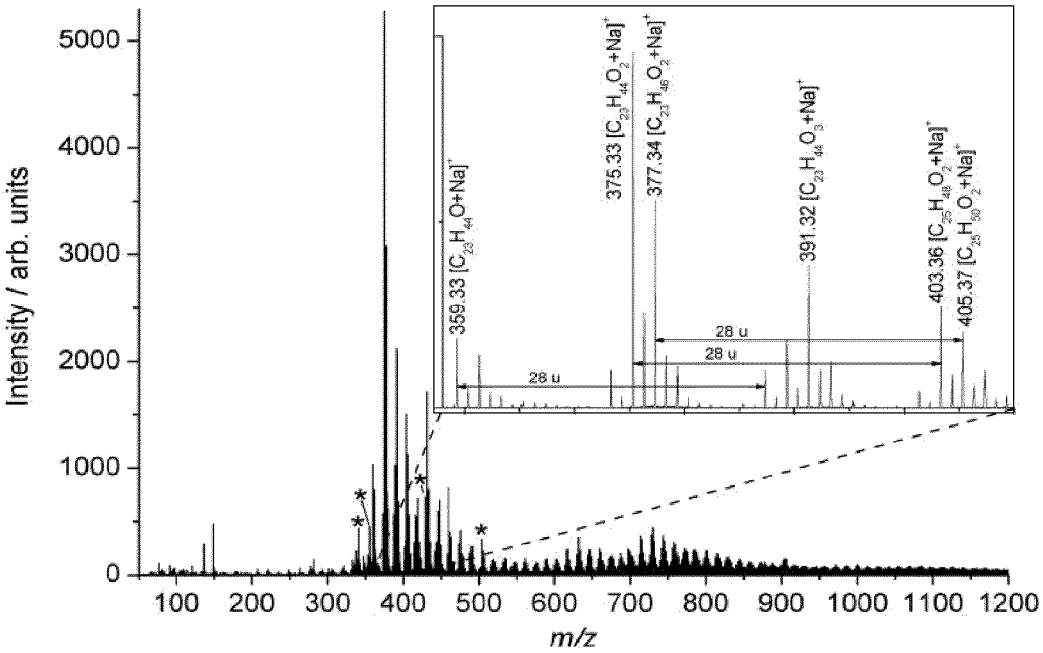
FIG. 28 is a Q-TOF mass spectrum obtained from a living female fly showing the full mass range in positive ion mode.

In FIG. 28 a representative field-based ion generation (FBIG) mass spectrum obtained from a living female fly using Q-TOF-MS is shown. In particular, FIG. 28 shows a Q-TOF mass spectrum obtained from a living female fly in positive ion mode. Expanding the area between m/z 358-412 (inset) visualizes ion series differing by 28 u. Chemical compositions are suggested for selected ions as shown in following Table 2. Ion signals and series are partially overlapping in the diagram in FIG. 28. Further, peaks produced from contaminants in the laboratory air are marked in the diagram with an asterisk.

Mass spectra recorded with IT-MS were comparable in terms of the observed ion series. The spectra were highly complex and in some cases exhibited ions up to about m/z 1800. Ion series were observed that showed 28 u mass differences. Spectra measured in positive ion mode were typically more complex than those recorded in the negative ion mode, presumably due to overlapping series of protonated, sodiated and potassiated molecules. The ion signals taken at one position of a fly were stable for at least 20 min. Based on the high mass accuracy of the Q-TOF instrument tentative assignment suggested the presence of series of oxygen-containing hydrocarbons, each being successively elongated by $C_2H_4$ groups, in protonated and sodiated form. Some of the signals at higher m/z values are possibly derived from dimers and multimers.

In the experiment collision-induced dissociation of abundant ions was performed. Thereby, the ions marked with an asterisk in FIG. 28 (m/z 341.03, 355.07, 429.09, 503.11) can be unequivocally assigned to polycyclosiloxanes. Their MS/MS spectra provided intense fragment ions corresponding to linear and cyclic methylsiloxanes. Those were already described as contaminants in laboratory air in a historic textbook by Biemann. It could also be shown that the application of a voltage to macroscopic sharp tips, both conducting (stainless steel injection syringe needle tip Microlance3, Becton Dickinson, Fraga, Spain) and insulating (pulled glass capillary), allowed the detection of these molecules. Dimethicone (Hidrofugal, Beiersdorf, Hamburg, Germany) sprayed into the laboratory atmosphere increased the ion abundance of polydimethylsiloxanes by more than 3 orders of magnitude.

The other ions observed in FIG. 28 were probed with MS/MS, wherein the current assignment is based on their mass and isotope pattern. Siloxanes could be distinguished by their characteristic isotopes, but overlapping ion series complicated the isotope fit so that most often only two isotopes could be used. For element selection it was considered that insect cuticular compounds include hydrocarbons, free fatty acids, alcohols, esters, glycerides, aldehydes, ketones and sterols.

As is presented in following Table 2 for the intense ions between m/z 300-500 oxygen-containing HCs both protonated and sodiated can be detected. Multimer formation can also not be excluded in particular for the ions in the higher mass range.

Table 2 shows a selection of ions observed in field-based ion generation (FBIG)-Q-TOF-MS and possible composition considering 10 ppm mass error and isotope fit. As sample to be investigated a part of a leg of a fruit fly as shown exemplary in FIGS. 24 and 25 was used.

TABLE 2

| m/z | | Δ m/z | |
|---|---|---|---|
| Observed | Calculated | ppm | Formulas |
| 359.3290 | 359.3290 | 0 | C23H44ONa |
| | 359.3314 | −6.7 | C25H43O |
| 375.3262 | 375.3239 | 6.1 | C23H44O2Na |
| | 375.3263 | −0.3 | C25H43O2 |
| 377.3400 | 377.3396 | 1.1 | C23H46O2Na |
| | 377.3420 | −5.3 | C25H45O2 |
| 391.3217 | 391.3188 | 7.4 | C23H44O3Na |
| | 391.3212 | 1.3 | C25H43O3 |
| 403.3566 | 403.3552 | 3.5 | C25H48O2Na |
| | 403.3576 | −2.5 | C27H47O2 |
| 405.3671 | 405.3709 | −9.4 | C25H50O2Na |
| 419.3518 | 419.3501 | 4.1 | C25H48O3Na |
| | 419.3525 | −1.7 | C27H47O3 |
| 431.3867 | 431.3889 | −5.1 | C29H51O2 |
| | 431.3865 | 0.5 | C27H52O2Na |
| 433.4019 | 433.4022 | −0.7 | C27H54O2Na |
| | 433.4046 | −6.2 | C29H53O2 |
| 445.3765 | 445.3810 | −10.1 | C31H50Na |
| 447.3769 | 447.3814 | −10.1 | C27H52O3Na |
| 459.4187 | 459.4178 | 2 | C29H56O2Na |
| | 459.4202 | −3.3 | C31H55O2 |
| 473.3940 | 473.3971 | −6.5 | C29H54O3Na |
| | 473.3995 | −11.6 | C31H53O3 |
| 475.4025 | 475.3999 | 5.5 | C27H55O6 |

Since cuticular microstructures such as hairs and papillaries influence ionization, the fly body itself should function as emitter of exogenously applied compounds as well.

To test this, synthetic HC standards were directly applied to intact flies and to specimens that had been washed with solvent to remove endogenous HCs.

For the experiments flies were washed in solvents such as hexane or methanol. This treatment reduced the abundance of the ion series typically observed under FBIG-conditions. Depending on the physical-chemical properties of the solvent, ion generation was reduced or contaminant ions were detected.

In FIG. 29*a*, the fly was held, e.g., only by a metal tip. FIG. 29*a* shows an ion trap (IT) mass spectra, wherein solutions of synthetic compounds HC1 and HC2 were applied to the body of a female fly and measured with field-based ion generation (FBIG). For the experiments shown in FIG. 29*a*, instrument parameters were: voltage 2.5 kV, dry gas 5 l/min, 50° C., target mass 345 (normal mode). Further, before measurement the fly had been stored at −20° C. for 12 days.

In the test on which the mass spectra in FIG. 29*a* is based, compounds such as Z-11-hexadecenyl acetate (HC1) and Z-11-hexadecen-1-ol (HC2) were detected as protonated and possibly alkali-cationized ions. However, the experiment can have limited reproducibility due to solvent-based changes on the fly body.

Nevertheless, traditional field emitters containing dendrite whiskers or other similarly structured emitters promote ionization of analytes as well as shown in FIG. 29*b*.

These experiments were performed applying a phosphazene reference mixture to commercial field desorption (FD) emitter means (Linden CMS, Leeste, Germany). These emitter means allows the detection of the prominent ions of this solution as shown in FIG. 29*b* below.

A particular robust emitter means is for example a single sharp metal tip or a plurality of such metal tips.

In FIG. 29*b* a stainless steel syringe needle was, therefore, tested with and without sample to study the ion generation from liquid and gaseous samples under FBIG-conditions.

FIG. 29*b* shows an APCI-MS/MS spectrum of HC2 applied to a sharp metal tip. In particular, 1 μl of HC2 solution was applied to the tip of a syringe metal needle cut to a length of, e.g., 3 cm and allowed to dry. An example of a sharp metal tip, which can be used as an emitter means in the experiment as described with respect to FIG. 29*b*, is shown in following FIG. 30.

Further, for the experiments shown in FIG. 29*b*, instrument parameters were: high voltage 2.2 kV, electrode current 43 nA, dry gas 5 l/min and 300° C., target mass 500 (normal mode). The signal decayed but was detectable for up to 45 min. The data acquisition was achieved with the instrument specific software.

The mass spectra shown for example in FIGS. 29*a,b* and in FIG. 30 below were further processed using MoverZ (Genomics Solution, Ann Harbor) and Origin (Originlab, Northhampton, Mass., USA).

Clean needle tips in the experiment in FIG. 29*b* caused the ionization of gaseous compounds such as siloxanes from the laboratory air. To some extent, also non-conducting sharp tips such as those formed by a pulled glass capillary can replicate this effect when attached to a blunt electrode. When a drop of analyte-containing liquid is placed on a syringe metal tip, various compounds can be detected, but this particular experiment resembles PEST. That method allows ESI measurements from complex samples of peptides, lipids and oligosaccharides using single sharp emitters like acupuncture needles. Tungsten oxide nanowires have also been used to demonstrate ESI-MS of such biomolecules. These results suggest that the ion generation at ambient conditions using multiple- or single-point emitters (like those present in the fly) may contain elements of ESI processes, in particular since the ambient air provides moisture.

As can be derived from FIG. 29*b*, ions of the oxygen-containing synthetic compounds HC1, HC2, and HC3 (Z-11-hexadecenal) can be generated using a syringe needle tip as sample holder. Thereby the faint bluish light of the corona was visible. The sample could also be placed, e.g., about 1 mm below the discharge corona created from a clean metal tip indicating that volatile compounds were ionized. Protonated molecules of HC1, HC2, HC3 as well as Nipagin, an aromatic benzoic acid ester that is used as a preservative in fly food, could be detected in this way. Non-polar Z-9-tricosene did not produce a signal under those conditions. These results indicate that APCI processes may contribute to field-based ion generation (FBIG) as well.

In FIG. 29*c* a scanning electron microscopy of a syringe metal tip 68 is shown, which can be used in the test in FIG. 29*b*. The tip radius of the syringe is in the present case, e.g., R=4.7 μm.

Figure 30:
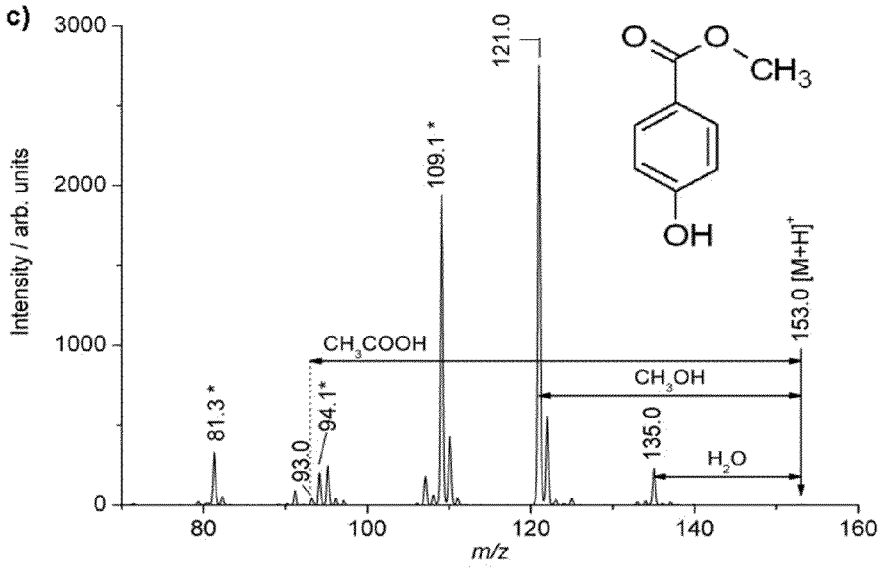
FIG. 30 is an MS/MS-spectrum of the major signal obtained from fly food measured with APCI.

Further, in FIG. 30 an ion trap (IT)-MS/MS-mass spectrum is shown of the major signal obtained from fly food in APCI. The spectrum was generated by holding a pipette plastic tip loaded with fly food about 1 mm underneath the corona discharge (extraction voltage 2.5 kV). The observed fragments allow the assignment to the preservative Nipagin. Peaks marked with an asterisk in FIG. 29*c*, were not observed in the corresponding electron impact spectra. The ion trap (IT) parameter were as follows: voltage 2.5 kV, current 101 nA, dry gas 2 l/min at 50° C., target mass 500 and wide mode.

The results, as shown for example in FIGS. 28, 29*a*, 29*b* and 30, indicate that natural or artificial microstructures are intrinsic to the field-based ion generation (FBIG) process. The geometry of hairs on fly legs seems to be particularly suited and they can be replicated, e.g., by graphite whiskers or tungsten nanowires for use in analytical chemistry.

The phenomenon of field-based ion generation (FBIG) has a number of versatile applications relevant to analytical and material science as well as behavioural biology. It offers an economical and technically simple method for the analysis of oxygen-containing HCs and a number of other small molecules from complex samples using most commercial atmospheric pressure (AP) sources. Improvements of the ion source with respect to the investigation of small animals will provide a minimal invasive way to monitor the chemical communication of living insects concurrent with behaviour.

Figure 31A:
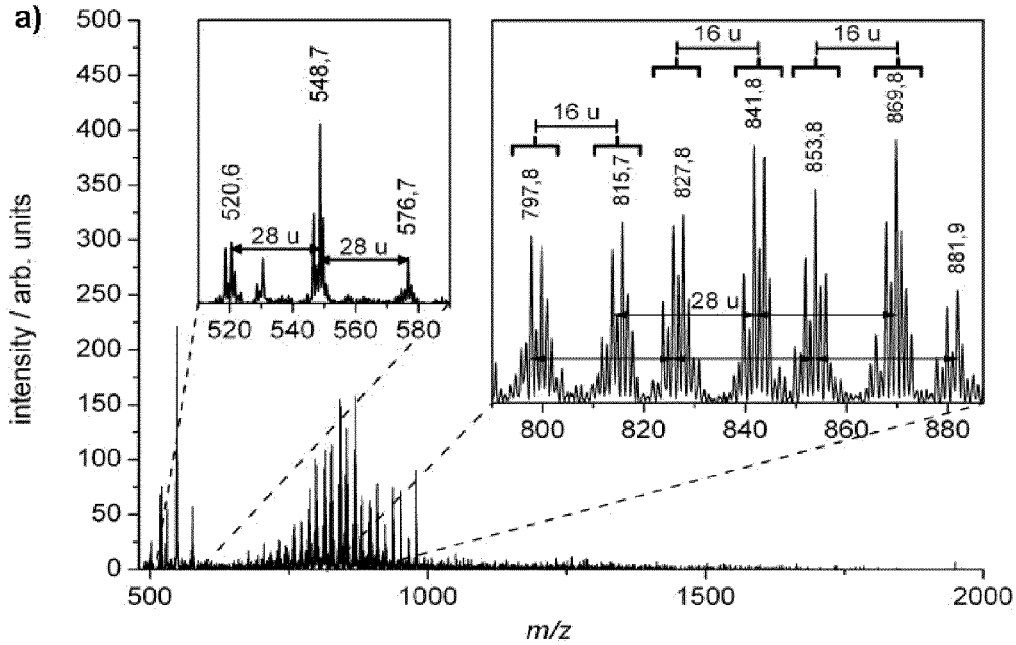
FIG. 31*a* is a diagram showing an ion trap signal of a female fly in positive ion mode.

The following FIGS. 31*a,b* to 40 show further measurements, wherein different emitters or emitter means, respectively, are used for field-based ion generation (FBIG).

In FIGS. 31*a*, 31*b* and 32 to 38 flies or parts of flies are used as emitters. Further, in FIG. 39 a traditional emitter is used, i.e., a Linden emitter, and in FIG. 40 a syringe metal tip is used as an emitter.

FIG. 31*a* shows an ion trap signal from a female fly in positive ion mode. In the present case, ion trap (IT) parameters include a voltage of 2.5 kV, dry gas at 325° C., a target mass of 1000, a normal mode and an acquisition time in a range of 0.5 to 1 min. The insets zoom in the diagram in FIG. 31*a* show prominent peaks differing by 28*u*.

Figure 31B:
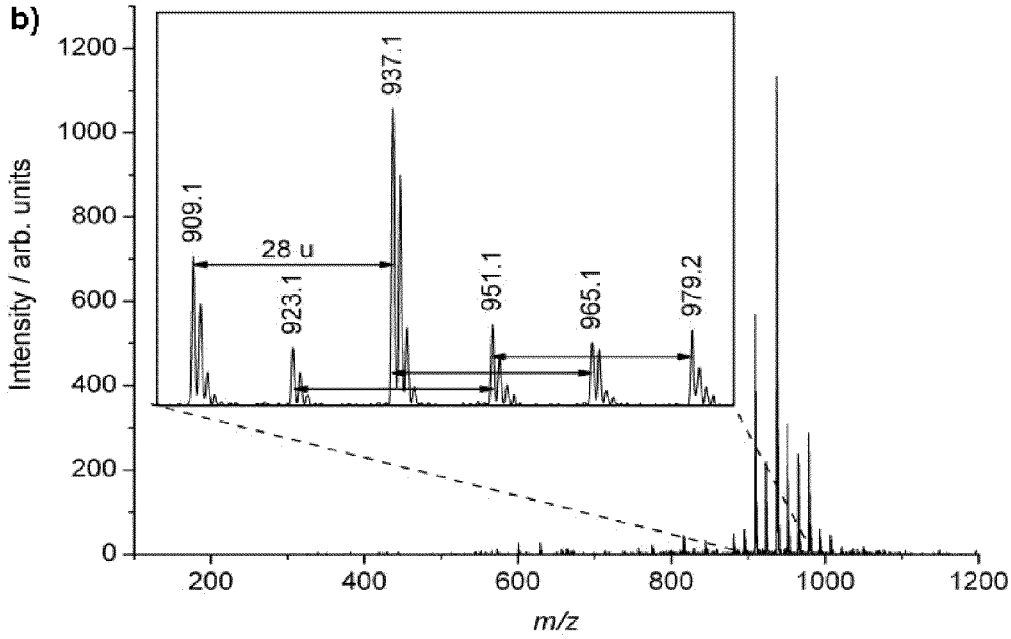
FIG. 31*b* is a diagram showing anion trap signal of a male fly in negative ion mode.

FIG. 31*b* shows an ion trap signal from a male fly in negative ion mode. The ion trap (IT) parameters where as follows: voltage 4 kV, dry gas at 300° C., target mass of 1000, acquisition time in a range of 0.5 to 1 min and normal mode. The insets zoom in the diagram in FIG. 31*b* show also prominent peaks differing by 28*u*.

Figure 32:
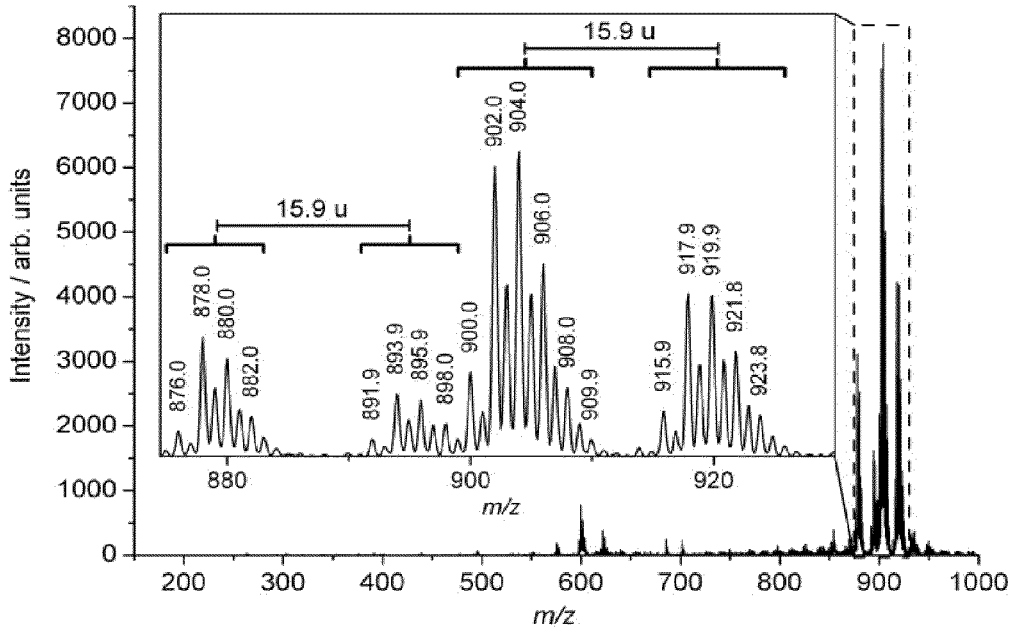
FIG. 32 is a diagram of a measurement of a male fly, which is measured with field-based ion generation (FBIG)-IT using a nanospray source adapter.

Further, in FIG. 32 a diagram of a male fly measured with a field-based ion generation (FBIG)-ion trap (IT) is shown, using a nanospray source adapter. The measurement was based on the following parameters: dry gas 4 l/min at 50° C., voltage of 2.5 kV, target mass 500 and wide mode.

Figure 33:
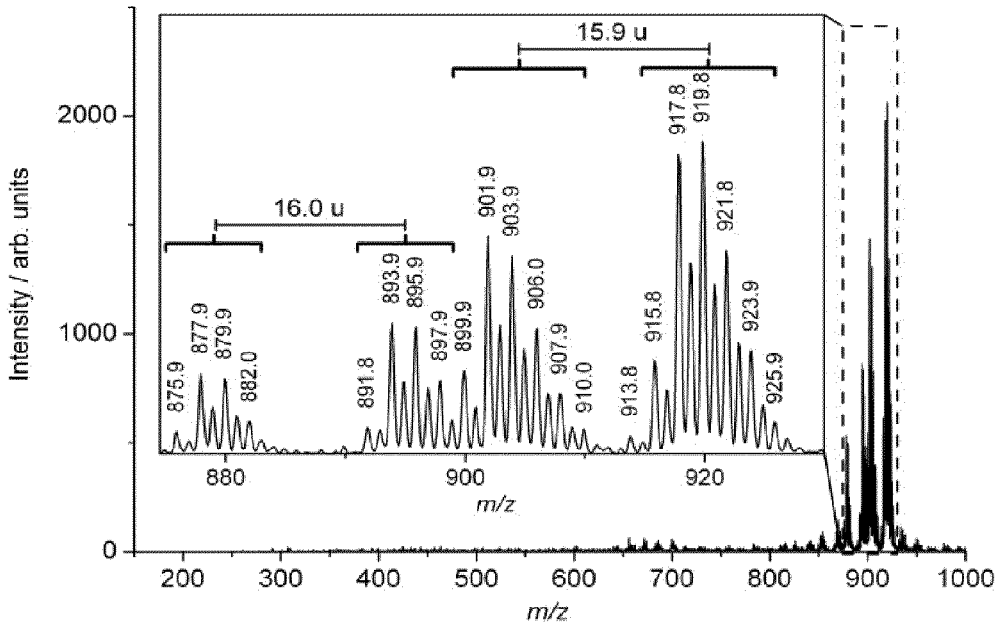
FIG. 33 is a diagram of a measurement of a female fly, which is measured with FBIG-IT using an AP-MALDI source.

In FIG. 33 a diagram of a live female fly is shown measured with field-based ion generation (FBIG)-ion trap (IT) using an AP-MALDI source. In the present case, the measurement was based on the following parameters: dry gas 5 l/min at 50° C., voltage 4 kV, target mass 900 and normal mode.

Figure 34:
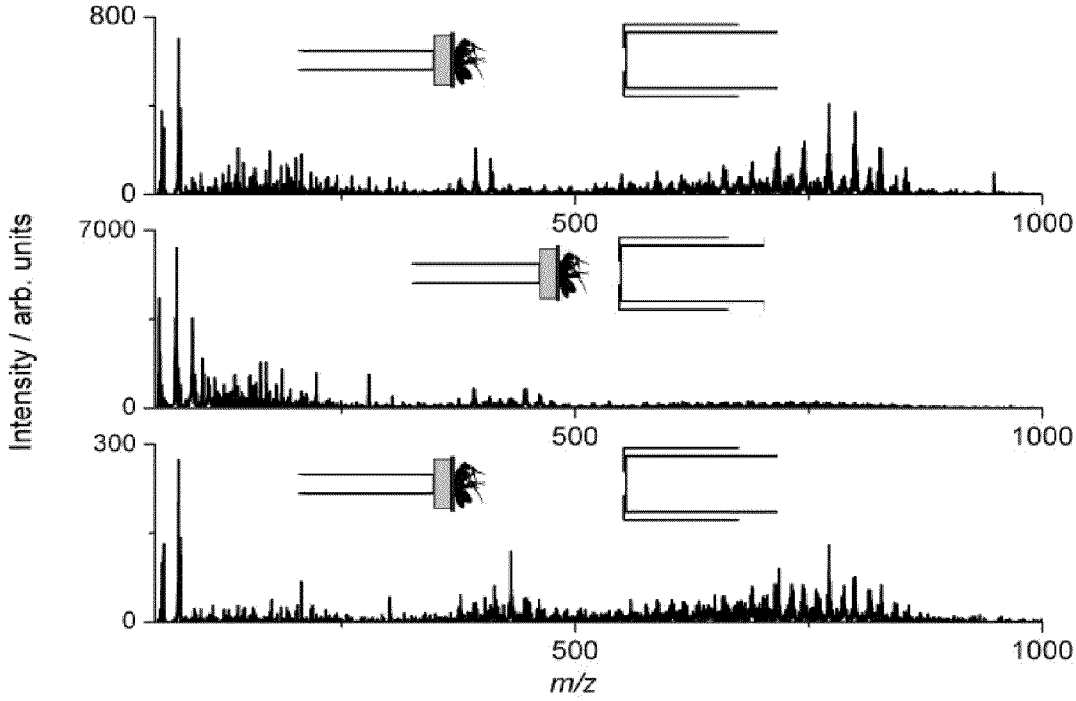
FIG. 34 is a FBIG-IT mass spectrum of a female fly, wherein the distance of the entrance capillary is varied.

Furthermore, in FIG. 34 a field-based ion generation (FBIG)-ion trap (IT) mass spectrum of a female fly is shown, wherein the distance of the fly to the entrance capillary was varied between for example 1 to 3 mm. As can be derived from the diagram, at smaller distances ions at lower mass show increased abundance. The measurement was conducted based on the following parameters: a voltage of 2.5 kV, no dry gas and a target mass of 500.

Figure 35:
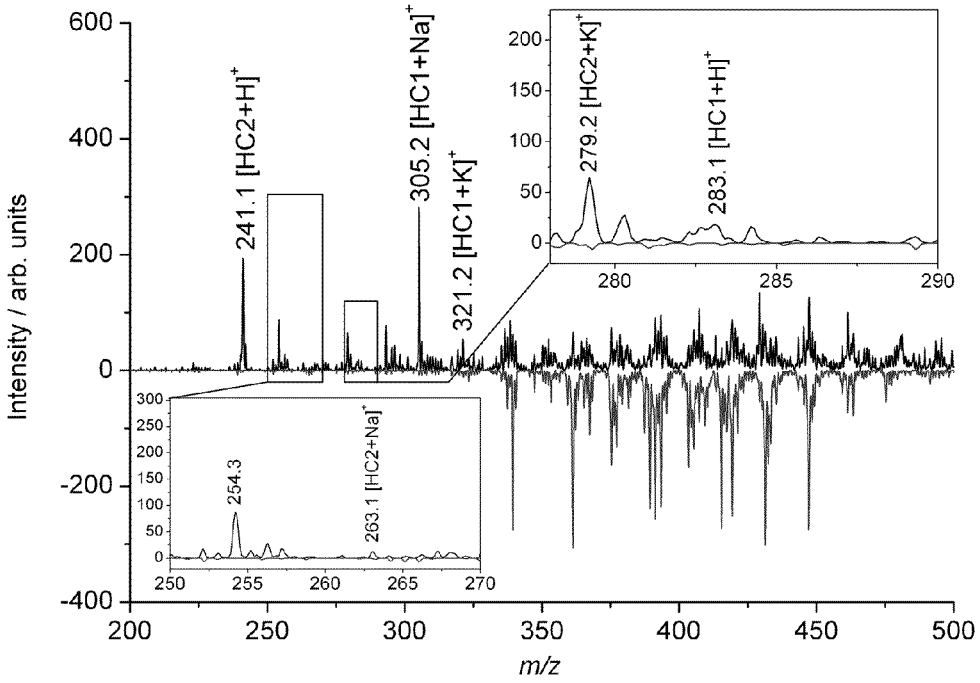
FIG. 35 is a FBIG-IT mass spectrum of a female fly with synthetic HC1 (Z-11-hexadecenyl acetate) and HC2 (Z-11-hexadecen-1-ol) and without standards.

In FIG. 35 a field-based ion generation (FBIG)-ion trap (IT) mass spectrum of a female fly with synthetic HC1 and HC2 is shown. The measurement of the top curve of the IT mass spectra was based on applying 3 nmol/μl and 300 pmol/μl in methanol. Further, 5 μl of this solution was applied to the fly body. The measurement of the bottom curve was conducted without the synthetic compounds. The parameters for the measurements include dry gas 5 l/min at 50° C., a target mass of 345 and a normal mode.

Figure 36:
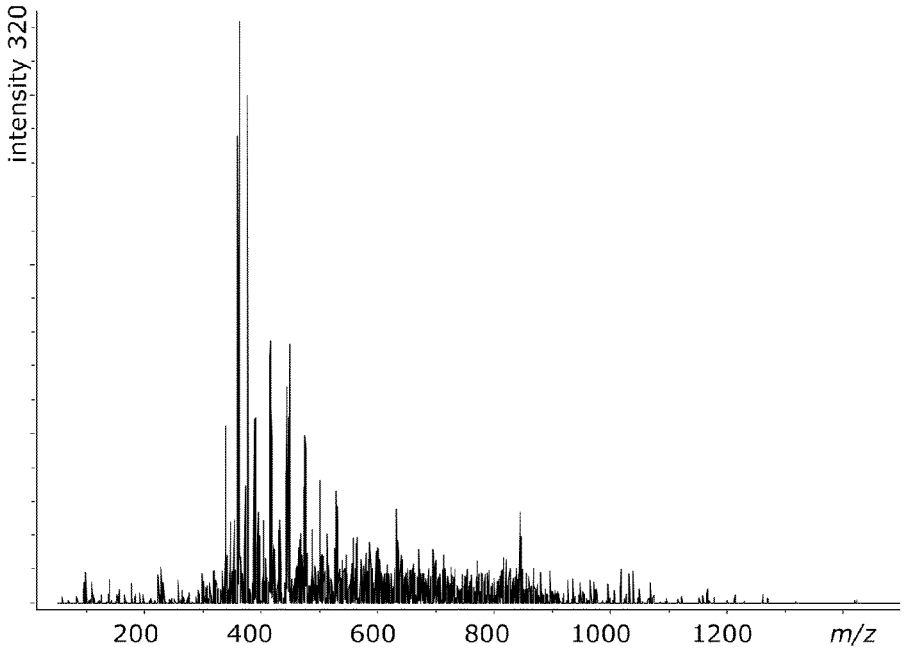
FIG. 36 is a FBIG-ion trap (IT) mass spectrum of a 3 day old living female fly in positive ion mode re-measured after a break.

FIG. 36 shows a field-based ion generation (FBIG)-ion trap (IT) mass spectrum of a 3 day old living female fly in positive ion mode re-measured after a break. The fly with the holding means had been removed from the ion source means and stored in the laboratory at room temperature for 3 h 30 min before this experiment. Ion trap (IT) parameters are as follows: voltage 3.5 kV, dry gas at 50° C., target mass 1000, normal mode, acquisition time between 0.5 to 1 min.

Figure 37:
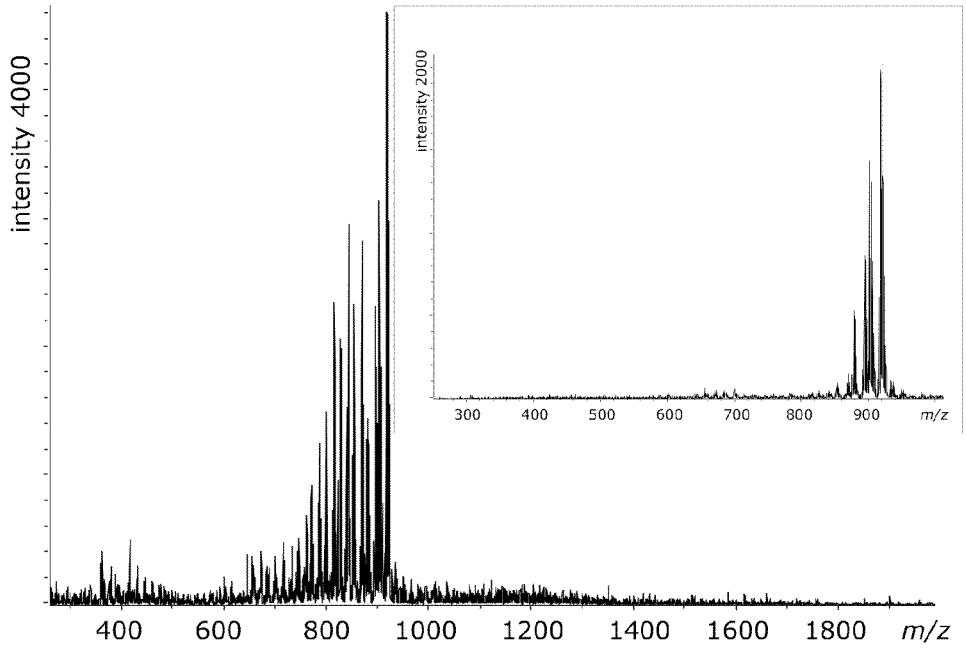
FIG. 37 is a FBIG-IT mass spectrum of fly fore legs in positive ion mode (AP-MALDI stage)

Further, in FIG. 37 a field-based ion generation (FBIG)-ion trap (IT) mass spectrum of fly fore legs in positive ion mode (AP-MALDI stage) is shown. The inset in FIG. 37 refers to the hind legs. The ion trap (IT) parameters comprise a voltage of 4 kV, a dry gas at 50° C., a target mass of 1000, a normal mode and an acquisition time between 0.5 to 1 min.

Figure 38:
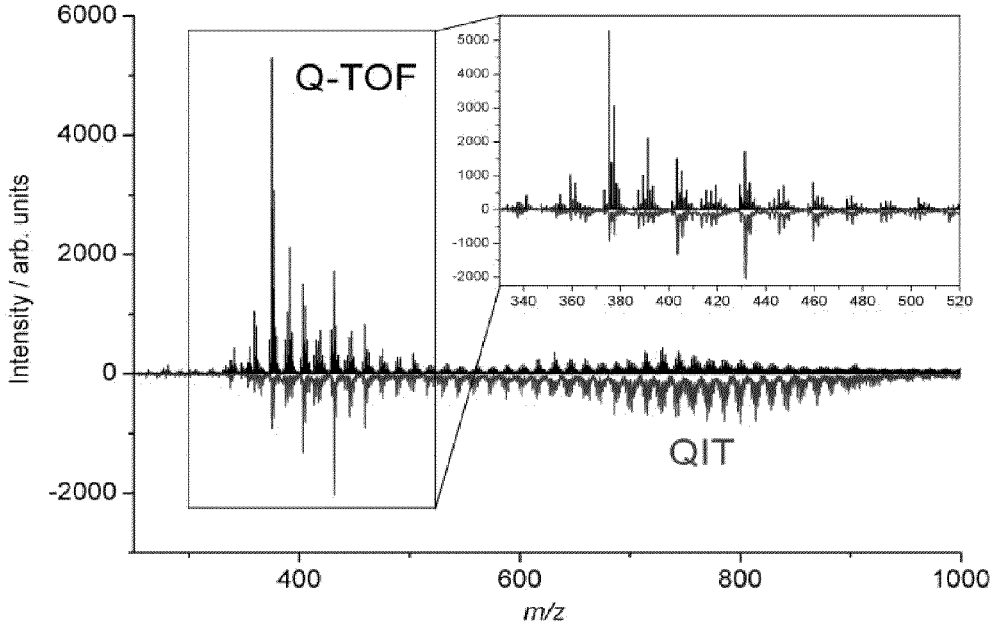
FIG. 38 is a diagram showing a comparison of mass spectra of two female flies measured with Q-TOF and ion trap (IT) mass spectrometers.

In FIG. 38 a comparison of mass spectra of two female flies measured with Q-TOF and ion trap (IT) mass spectrometers is shown. In the present case the ion trap (IT)-parameters include a target mass of 500, no dry gas, a wide mode and a voltage of 2.5 kV.

Figure 39:
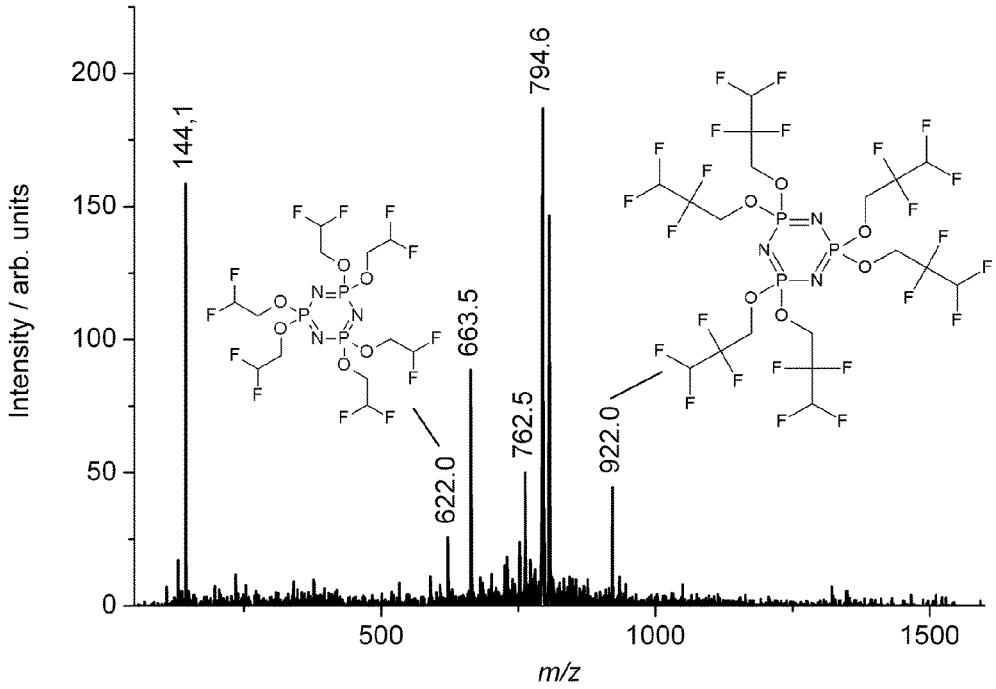
FIG. 39 is a FBIG-IT mass spectrum, wherein a Linden emitter is used.

FIG. 39 is directed to the use of a traditional emitter. In FIG. 39 a field-based ion generation (FBIG)-IT mass spectra is shown, wherein a Linden emitter is used. Examples of such emitters are shown in FIGS. 3, 4 and 8 above. Further, ion trap (IT) tune solution (fluorinated phosphazenes; Agilent G2421 A) was applied for the measurement. The parameters for the measurement included dry gas 5 l/min at 100° C., a voltage of 3.5 kV and a target mass of 900.

Figure 40:
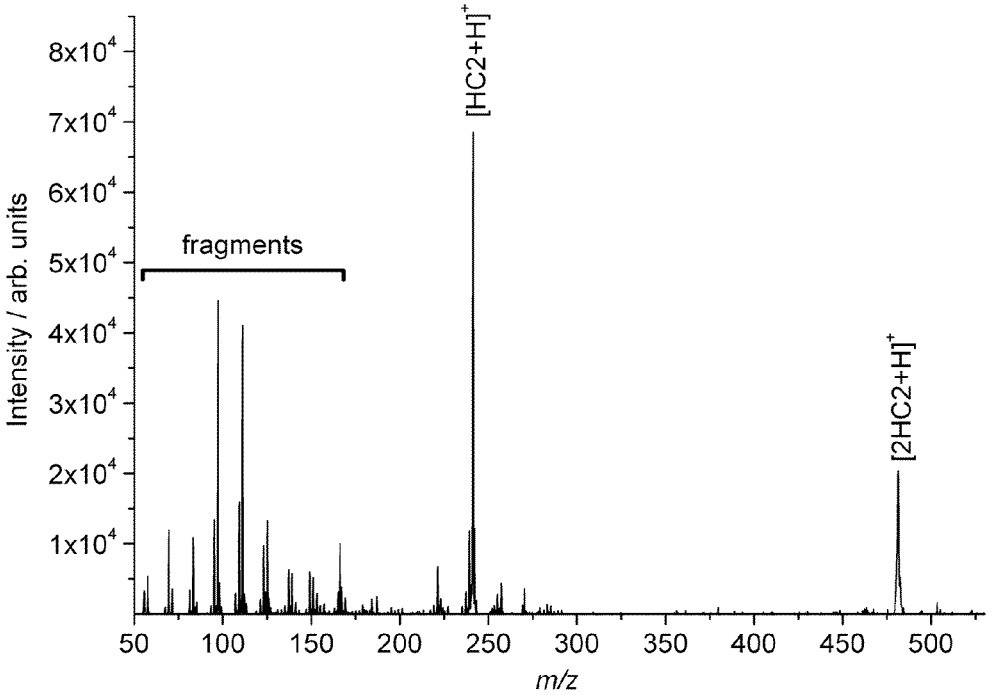
FIG. 40 is a diagram showing an APCI-IT mass spectrum of HC2 (10 nmol/μl) using a syringe metal tip.

In FIG. 40 a syringe metal tip is used as an emitter. In particular, FIG. 40 shows an AVCS-IT mass spectrum of HC2 (10 nmol/μl) using the syringe metal tip as an emitter. Protonated monomer and dimer ions are detected as well as fragment ions. The measurement included the following parameters: a voltage of 2.2 kV, dry gas 5 l/min at 280° C., a target mass of 500 and a normal mode.

In the experiments shown, different emitter types (flies, microdendrites and metal tips) were used. They show ion generation of volatile compounds present in the laboratory air (e.g., siloxanes) and of some classes of other molecules, e.g., oxygen-containing hydrocarbons and small molecules such as Nipagin. The experiments using flies show the potential of FBIG for the behavioural sciences. Live insects can be investigated in real-time. For the analytical sciences, artificial emitters which can be reproducibly generated and allow easy handling are very important.

In the above experiments or tests, respectively, both living and previously frozen animals can be used with similar results. In the current configuration, the reproducibility from sample to sample was limited in terms of the observed ion patterns and intensities. The strength of individual signals varied with changes of the position of the fly with respect to the entrance capillary of the mass spectrometer—either due to re-positioning of the sample holder by the operator or due to movements of the fly itself. Utilization of miniaturized ion funnels or cap means as shown in FIG. 5 can provide a means to collect ions from a more defined part of the insects and thus help to further improve reproducibility. When individual body parts were dissected and measured under FBIG conditions, it has been noted that the legs of the flies showed signals of considerably greater intensity than other body regions.

As sort of fly used in the experiments above, Canton S *D. melanogaster* were raised on autoclaved yeast-sucrose-agar food at 25° C. For preparation of samples, fruit flies were anesthetized by brief exposure to cold. Individual flies were taped to adapters for the respective ion sources using, e.g., double-sided stickers. Synthetic HCs (ISCA Technologies, Riverside, Calif.) were prepared as 1% solutions in methanol.

By using fine forceps, individual flies were taped to the respective holding means using, e.g., double-sided stickers (G304, Plano Wetzlar, Germany). Mated and unmated female flies were not differentiated. Dead flies or flies which had been stored for several days at −20° C. can also be used.

For the ion tape (IT) experiments using the AP-MAUI source described before, instrumental parameters were essentially adopted from settings for UV-MALDI-MS except for the ion charge control acquisition time (e.g., 200 ms). The UV laser means was kept in stand-by to allow the use of the target control software for positioning of the flies. Sample observation in real time was possible via a standard CCD camera, as shown in FIGS. 5 and 19. A voltage of, e.g., 2.5 kV was applied to the entrance capillary that also served as counter electrode for ion extraction while the sample support was held at ground potential. Conductivity of the holding means was not critical and measurement was also possible when the flies were fixed to glass slides. For fixation of the flies, stainless steel targets were machined, e.g., about 1 mm in depth to hold the flies directly or microscope slides which were taped to the metal using conductive stickers (G3357, Plano). When dissected body parts were investigated in the experiments described before, for example, a standard Agilent gold-coated sample plate was used. The signal intensity depended on the position of the flies in front of the capillary and spectra were taken at locations of maximum signal. For use of the commercial off-line nanospray source, a syringe needle was cut to a length of, e.g., 15 mm and used as the metal tube. The end of the tube held the fly in a number of variations (taped to a small plate, anti-static black conductive Teflon coated fibreglass tape (CSHyde Inc., Lake Villa, Il), or Plano stickers. Q-TOF Premier experiments were set up similarly. The lock mass baffle was not removed so far due to practical reasons.

According to the invention as described before an ion source means is provided that in combination with a mass analyzer device allows to non-destructively profile the molecular composition of surfaces including those of living animals and to use natural or artificial surfaces of nano/fine structure to analyse chemicals or biomolecules.

The inventive ion source means allows to study living organisms and to generate structural data. Further, the inventive ion source principle can straightforwardly be used with most types of mass analyzers. Furthermore, commercial ion sources can be transformed into the inventive ion source means (FLIE sources) using adapters. According to the invention sample targets with fine/nano structure can be used as emitters taking advantage of local high field strengths. Further, the development of novel applications in the analysis of biological and artificial material which is susceptible to the analysis is anticipated.

Further, according to the inventive method at least one or more analyte substances can be desorbed and/or ionised by providing an ion source means 16. As described above, the ion source means 16 comprises at least one holding means 22 for holding at least one sample 18 to expose the sample 18, e.g., to a mass analyzer device 14. The holding means 22 comprises a structured sample support means 10, 12, 17, 50, 62 for supporting the sample 18 and/or a structured sample

18, 17, 38. Preferably the inventive method is carried out at substantially atmospheric pressure AP. To desorb and/or ionise at least one or more analyte substance a voltage difference is provided between the sample holding means 22 or the sample 18, respectively, and a counter electrode 26. The voltage difference is chosen so that it is sufficient to desorb ions and/or molecules from the sample 18 and/or to desorb and ionise molecules from the sample 18. The ions or ionised molecules can be then for example measured and evaluated. The ions and ionised molecules can be further transferred, e.g., to a mass analyzer device 14 as described before.

Furthermore, the invention solves the following technical/analytical disadvantages: That living organisms cannot be studied by mass spectrometry. Further, gaseous analytes such as, e.g., the breath and/or transpiration of an animal or human being, etc. cannot be analyzed by mass spectrometry. Furthermore, that large non-polar compounds like hydrocarbons which are non-volatile are difficult to desorb and ionise for subsequent MS analysis. Moreover, that matrix-free desorption of molecules and ions is possible from spotted samples atmospheric pressure AP applying only an electric field.

While this invention has been particularly shown and described with reference to preferred embodiments thereof, it will be understood by those skilled in the art that various changes in form, modification, variation and details may be made therein without departing from the scope of the invention as defined by the appended claims.

In particular, as a structured sample support means as used in the examples of the invention described before, for example in FIG. 19, also at least one, two, three or a plurality of needles can be used instead, wherein the needles have preferably a sharp tip. However, also needles with a blunt tip can be used or a combination of needles with a sharp tip and needles with a blunt tip. It has to be emphasized that instead of at least one, two or a plurality of needles with a sharp tip or a blunt tip any sharp or blunt pin or pins can be used. For example, at least one, two or a plurality of cylindrical pins and/or angular pins can be used as a structured sample support means for a respective sample such as for example a volatile, gaseous, liquid and/or pasty-like sample etc. The pins which are used as a structured sample support means can be provided, e.g., with a chamfered end or a plan end, wherein the end can be further sharp or blunt. Further, instead of a pin or needle at least one, two or a plurality of razor blades can be used, preferably sharp razor blades. However, even blunt razor blades can be used.

Further, the structured sample support means and/or the holding means can be electrically conductive. In case the structured sample support means and/or the holding means are made of an electrically non-conductive material, they can be made electrically conductive by providing them with an additional electrical conductive means such as, e.g., a wire or wires and/or a layer or layers of an electrical conductive material etc. Thus, even a structured sample support means and a holding means which are made from an electrically non-conductive material can be used according to the invention by providing them with an electrical conductive means so that an electrical field can be generated according to the invention as described before in detail, e.g., with respect to FIGS. 5 and 19 etc.

| List of reference signs | |
|---|---|
| 10 | microdendrites |
| 12 | whiskers |

-continued

| List of reference signs | |
|---|---|
| 13 | surface |
| 14 | mass analyzer device |
| 15 | cross section |
| 16 | ion source means |
| 17 | papillaries |
| 18 | sample |
| 20 | emitter or emitter- means |
| 22 | holding means |
| 26 | capillary or capillary means |
| 28 | entrance (of capillary) |
| 30 | cap means |
| 32 | tube element |
| 34 | opening |
| 36 | funnel |
| 38 | hair |
| 40 | insect body |
| 42 | fly leg |
| 43 | fly foot |
| 44 | counter gas means |
| 46 | air supply means |
| 47 | post-ionisation means |
| 48 | metal contact |
| 50 | structured sample support means |
| 52 | sticker |
| 54 | base |
| 56 | plate |
| 58 | carrier element |
| 60 | tape |
| 62 | emitter |
| 64 | closed housing means |
| 66 | inlet (of closed housing means) |
| 68 | syringe metal tip |

The invention claimed is:

1. An ion source means, comprising:

at least one holding means for holding at least one sample to expose the sample to a mass analyzer device, wherein the holding means comprises:

a structured sample support means for supporting at least one of the sample, a structured sample and a sample comprising a structured surface, wherein a voltage difference is applied between the holding means and a counter electrode to perform at least one of desorbing at least one of molecules and ions and desorbing and ionising molecules from the sample of the ion source means under substantially atmospheric pressure.

2. The ion source means of claim 1, wherein the structured sample support means is provided with a fine structure, wherein the fine structure generates a local high field strength which supports at least one of desorption and ionisation of molecules and ions from a sample and desorption/ionisation of ions from a sample for mass analysis, wherein the fine structure is at least one of a microstructure, a nanostructure, a structure of microdendrites, whiskers, papillaries, pins, tips, edges and wires, wherein at least one analyte substance is brought into contact with the structured sample support means as a sample to be analyzed, wherein an analyte substance is at least one of a solid substance, a paste-like substance, a volatile substance, a liquid substance and a gaseous substance, wherein the analyte substance is analyzed under the presence of at least one of a liquid material, a gaseous material and a volatile material.

3. The ion source means of claim 2, wherein, the gaseous material is breath, wherein the breath is at least one of a breath of an animal, a breath of a human being, exhaust, aerosol and fume.

4. The ion source means according to claim 1, wherein, the structured sample support means comprises at least one needle, razor blade, chip, syringe, wire, tip and pin, wherein a respective needle, razor blade, chip, syringe, wire, tip or pin is provided preferably with at least one of a sharp end, a blunt end, a nanostructure, and a microstructure, wherein at least one analyte substance is brought into contact with the structured sample support means as a sample to be analyzed, wherein an analyte substance is at least one of a solid substance, a paste-like substance, a volatile substance, a liquid substance and a gaseous substance, wherein the analyte substance is analyzed under the presence of at least one of a liquid material, a gaseous material and a volatile material.

5. The ion source means of claim 1, wherein, the structured sample is at least one of a biological and an artificial material, wherein the artificial material is at least one of a part of a human being, a skin/cuticular part of a human being, a plant, a part of a plant, a living animal, a dead animal, a fruit fly, a body part of an animal.

6. The ion source means of claim 1, wherein, the ion source means comprises at least one of:

an air supply means to provide an additional flow of air or oxygen, a counter gas means for providing a flow of counter gas, wherein the temperature of the counter gas of the counter gas means is preferably variable, a laser means to assist at least one of desorption of ions and molecules and desorption/ionisation of ions from the sample, wherein the laser means comprises at least one of an IR laser and an UV laser, a desorption/ionisation means, wherein the desorption/ionisation means is an electrospray means to assist at least on of desorption of ions and molecules and desorption/ionisation of ions from the sample, a post-ionisation means to post-ionise desorbed neutral molecules, wherein the post-ionisation means comprises at least one of a beam of photons, electrons, electrospray droplets and chemically ionising compounds, a closed housing means for enclosing at least one of the sample (18), the sample and the structured sample support means (50), and an entrance of a capillary of a mass analyzer device, a camera means to control the positioning of at least one of the sample and the application of an analyte, a positioning means, wherein the positioning means is adapted to position the holding means of the ion source means in at least one, two and three dimensions, a sample preparation means, wherein the sample preparation means comprises a micromanipulator to position the sample on the structured sample support means.

7. The ion source means of claim 1, wherein, a voltage to generate the electrical field is applied to the ion source means, in particular the holding means, while the counter electrode is at ground potential or the other way round, wherein the applied voltage is at least in a range of between positive 1 kV to 4 kV and negative 1 kV to 4 kV.

8. The ion source means of claim 1, wherein, the holding means is at least one of a fixed holding means and a movable holding means adapted to be movable in at least one, two and three dimensions.

9. The ion source means of claim 1, wherein, the holding means is provided with at least one of a tape and a sticker, on which at least one of the structured sample and the structured sample support means is attached.

10. The ion source means of claim 1, wherein, the holding means comprises:

a fix plate element out of metal, wherein at least one of a tape and a sticker is provided on the plate element to attach at least one of the structured sample and the structured sample support means to the plate element, wherein at least one of the tape and the sticker is electrically conductive.

11. The ion source means of claim 1, wherein, the holding means comprises:

a carrier element which is at least fix and removable attached to the holding means by at least one of a magnet element and by a snap-in place connection, wherein at least one of a tape and a sticker, that is electrically conductive, is provided on the carrier element to attach at least one of the structured sample and structured sample support means to the carrier element.

12. The ion source means of claim 1, wherein, the holding means is provided with at least on of a field emitter means and a field emitter, wherein the field emitter means is provided with a structure to generate a local high field strength by providing at least one of a microstructure, a nanostructure, a structure of microdendrites, papillaries, pins, tips, edges and whiskers.

13. The ion source means of claim 1, wherein the holding means comprises:

a conductive, wherein the conductive is a metal contact, wherein the metal contact is at least one of a metal plate, a metal wire, a metal cone, a metal cylinder and at least one or more metal layers, to provide an electrical potential at the sample.

14. A mass spectrometer device comprising:

an ion source means, comprising:

at least one holding means for holding at least one sample to expose the sample to a mass analyzer device, wherein the holding means comprises:

a structured sample support means for supporting at least one of the sample, a structured sample and a sample comprising a structured surface, wherein a voltage difference is applied between the holding means and a counter electrode to perform at least one of desorbing at least one of molecules and ions and desorbing and ionising molecules from the sample of the ion source means under substantially atmospheric pressure, wherein the mass analyzer device of the mass spectrometer device is at least one of a Q-TOF mass spectrometer device, a time-of-flight (TOF) mass spectrometer device, an orthogonal-extracting TOF mass spectrometer device, a quadrupole mass spectrometer device, an ion trap mass spectrometer device and a Fourier transform ion cyclotron resonance mass spectrometer device.

15. The mass spectrometer device according to claim 14, wherein the mass analyzer device of the mass spectrometer device comprises at least one collecting means to collect ions from the sample.

16. The mass spectrometer device of claim 14, wherein a cap means is provided at an entrance of the collecting means, in particular a capillary entrance (28), wherein the cap means comprises at least one of an opening and a tube element, wherein the tube element forms at least one of a cylindrical tube and a funnel.

17. The mass spectrometer device of claim 14, wherein the mass spectrometer device comprises:

a holding means for holding at least one sample to expose the sample to a mass analyzer device, wherein the holding means comprises at least one of a structured sample support means for supporting the sample, a structured sample, and a sample comprising a structured surface.

18. The mass spectrometer device of claim 14, wherein the holding means comprises:

a conductive element to apply a voltage to the holding means to perform at least one of generating desorption of at least one of ions and molecules and desorption/ionisation of ions from the sample.

19. The mass spectrometer device of claim 14, wherein a collecting means of the mass spectrometer device comprises:

a cap means, wherein the cap means is provided at the entrance of the collecting means which collects ions from the sample and wherein the cap means comprises at least one of an opening and a tube element, wherein the tube element forms at least one of a cylindrical tube and a funnel.

20. A method including the steps of:

providing a mass analyzer device providing an ion source means, wherein the ion source means comprises at least one holding means for holding at least one sample to expose the sample to the mass analyzer device, wherein the holding means comprises a structured sample support means for supporting at least one of the sample and a structured sample, providing an atmosphere at substantially atmospheric pressure AP, providing a voltage difference between the sample holding means and a counter electrode which is sufficient to desorb at least one of ions and molecules from the sample.

21. A method for carrying out at least one of desorption and ionisation of molecules and ions from a sample and desorption/ionisation of ions from a sample for mass analysis according to claim 20.

* * * * *

UNITED STATES PATENT AND TRADEMARK OFFICE

CERTIFICATE OF CORRECTION

PATENT NO. : 8,410,452 B2
APPLICATION NO. : 12/994935
DATED : April 2, 2013
INVENTOR(S) : Koenig et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 158 days.

Signed and Sealed this
First Day of September, 2015

Michelle K. Lee

Michelle K. Lee
*Director of the United States Patent and Trademark Office*